US011435674B2

(12) United States Patent
Okazaki et al.

(10) Patent No.: US 11,435,674 B2
(45) Date of Patent: *Sep. 6, 2022

(54) ELECTROPHOTOGRAPHIC PHOTORECEPTOR, PROCESS CARTRIDGE, AND IMAGE FORMING APPARATUS

(71) Applicant: FUJI XEROX CO., LTD., Tokyo (JP)

(72) Inventors: Yuto Okazaki, Kanagawa (JP); Wataru Yamada, Kanagawa (JP); Masahiro Iwasaki, Kanagawa (JP); Keisuke Kusano, Kanagawa (JP); Taisuke Fukui, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/933,120

(22) Filed: Jul. 20, 2020

(65) Prior Publication Data

US 2021/0302850 A1 Sep. 30, 2021

(30) Foreign Application Priority Data

Mar. 26, 2020 (JP) ..... JP2020-056880

(51) Int. Cl.

| | |
|---|---|
| ***G03G 5/147*** | (2006.01) |
| ***G03G 21/00*** | (2006.01) |
| ***G03G 5/07*** | (2006.01) |

(52) U.S. Cl.

CPC ..... *G03G 5/14726* (2013.01); *G03G 5/078* (2013.01); *G03G 5/14734* (2013.01); *G03G 5/14756* (2013.01); *G03G 21/0011* (2013.01); *G03G 21/0017* (2013.01)

(58) Field of Classification Search

CPC ..... G03G 5/14726; G03G 5/14791; G03G 5/14734; G03G 5/14756

USPC ..... 430/66

See application file for complete search history.

(56) References Cited

U.S. PATENT DOCUMENTS

| | | | | |
|---|---|---|---|---|
| 11,048,181 | B2 * | 6/2021 | Iwasaki | G03G 21/1803 |
| 2005/0014080 | A1 * | 1/2005 | Tong | G03G 5/061443 430/59.4 |
| 2009/0226208 | A1 * | 9/2009 | Nukada | G03G 5/0578 399/111 |
| 2013/0101929 | A1 * | 4/2013 | Korenaga | G03G 5/14795 430/58.65 |

FOREIGN PATENT DOCUMENTS

| | | | |
|---|---|---|---|
| JP | 2000-292960 | A | 10/2000 |
| JP | 3950559 | B2 | 8/2007 |

* cited by examiner

*Primary Examiner* — Peter L Vajda
*Assistant Examiner* — Boone Alexander Evans
(74) *Attorney, Agent, or Firm* — Sughrue Mion, PLLC

(57) ABSTRACT

An electrophotographic photoreceptor includes a conductive substrate and a photosensitive layer on the conductive substrate. The electrophotographic photoreceptor has an outermost surface layer that contains fluorine-containing resin particles and a fluorine-containing graft polymer. The fluorine-containing resin particles contain 0 or more and 30 or less carboxy groups per $10^6$ carbon atoms. The outermost surface layer has a dielectric constant of 3.75 or more and 3.90 or less. The contact angle of pure water on the outermost surface layer is 90° or more.

18 Claims, 5 Drawing Sheets

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2020-056880 filed Mar. 26, 2020.

BACKGROUND

(i) Technical Field

The present disclosure relates to an electrophotographic photoreceptor, a process cartridge, and an image forming apparatus.

(ii) Related Art

Japanese Patent No. 3950559 proposes "an electrophotographic apparatus that forms images by applying an imaging forming process that includes a step of charging a surface of a body to be charged by using a charging unit, in which: the body to be charged is an electrophotographic photoreceptor that includes a conductive support, a charge generating layer, and a charge transporting layer that are stacked in this order, the charge transporting layer being formed by dip-coating and constituting a surface layer; the surface layer contains a charge transporting material, a binder resin, and a silicone defoaming agent; the silicone defoaming agent is dimethylpolysiloxane; the dimethylpolysiloxane content in the surface layer relative to the binder resin is 0.002 to 0.01 wt %; and the charging unit that charges the body to be charged is a direct charging device that charges the surface of the body to be charged by causing a charging member to which voltage is applied to abut against the body to be charged".

Japanese Unexamined Patent Application Publication No. 2000-292960 proposes "an electrophotographic photoreceptor that includes a conductive support, and a photosensitive layer and a protective layer stacked on the conductive support, in which the protective layer contains conductive particles, a fluorine atom-containing compound, a siloxane compound, fluorine atom-containing resin particles, and a binder resin".

SUMMARY

Aspects of non-limiting embodiments of the present disclosure relate to an electrophotographic photoreceptor in which the residual potential is decreased and occurrence of air bubbles in the surface of the outermost surface layer is suppressed compared to an electrophotographic photoreceptor including a conductive substrate and a photosensitive layer on the conductive substrate, in which the electrophotographic photoreceptor has an outermost surface layer that contains fluorine-containing resin particles and a fluorine-containing graft polymer, the fluorine-containing resin particles contain more than 30 carboxy groups per $10^6$ carbon atoms, the outermost surface layer has a dielectric constant of less than 3.75 or more than 3.90, the contact angle of pure water on the outermost surface layer is less than 90°, and, if the outermost surface layer further contains a defoaming agent, the amount of the fluorine-containing graft polymer relative to the amount of the fluorine-containing resin particles is less than 4.5 mass % or more than 9.0 mass %, and the amount of the defoaming agent relative to the outermost surface layer is less than 10 ppm or more than 10000 ppm.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an electrophotographic photoreceptor includes a conductive substrate and a photosensitive layer on the conductive substrate. The electrophotographic photoreceptor has an outermost surface layer that contains fluorine-containing resin particles and a fluorine-containing graft polymer. The fluorine-containing resin particles contain 0 or more and 30 or less carboxy groups per $10^6$ carbon atoms. The outermost surface layer has a dielectric constant of 3.75 or more and 3.90 or less. The contact angle of pure water on the outermost surface layer is 90° or more.

BRIEF DESCRIPTION OF THE DRAWINGS

Exemplary embodiments of the present disclosure will be described in detail based on the following figures, wherein.

DETAILED DESCRIPTION

Figure 1:
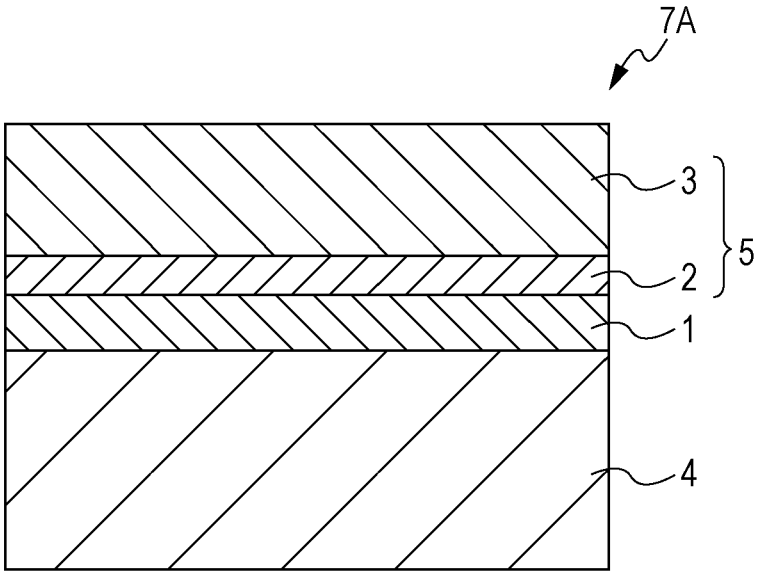
FIG. 1 is a schematic cross-sectional view of one example of a layer structure of an electrophotographic photoreceptor according to an exemplary embodiment.

Exemplary embodiments, which are some of the examples of the present disclosure, will now be described. The following descriptions and examples merely illustrate examples of the exemplary embodiments and do not limit the scope of the present disclosure.

For stepwise numerical ranges described in the present disclosure, the upper limit or the lower limit of one stepwise numerical range may be substituted with an upper limit or a lower limit of a different stepwise numerical range. In addition, for stepwise numerical ranges described in the present disclosure, the upper limit or the lower limit of any stepwise numerical range may be substituted with an upper limit or a lower limit described in the examples.

Each component may contain multiple corresponding substances.

When the amount of a component in a composition is referred and when there are two or more substances that correspond to that component in the composition, the amount is the total amount of the two or more substances in the composition unless otherwise noted.

Electrophotographic Photoreceptor

An electrophotographic photoreceptor (hereinafter may also be referred to as the "photoreceptor") according to a first exemplary embodiment includes a conductive substrate and a photosensitive layer on the conductive substrate, and the outermost surface layer of the electrophotographic photoreceptor contains fluorine-containing resin particles and a fluorine-containing graft polymer.

Furthermore, the number of carboxy groups contained in the fluorine-containing resin particles is 0 or more and 30 or less per $10^6$ carbon atoms, the dielectric constant of the outermost surface layer is 3.75 or more and 3.90 or less, and the contact angle of pure water on the outermost surface layer is 90° or more.

The photoreceptor of the first exemplary embodiment has a lower residual potential and less air bubbles in the surface of the outermost surface layer because of the aforementioned features. The reason for this is presumably as follows.

A method that involves adding fluorine-containing resin particles to the outermost surface layer of a photoreceptor is used to improve the wear resistance of the photoreceptor. The fluorine-containing resin particles containing 0 or more and 30 or less carboxy groups per $10^6$ carbon atoms improve the chargeability of the photoreceptor, but do not easily disperse evenly in the outermost surface layer-forming coating solution used for preparing the outermost surface layer, and thus there has been demand for improving dispersibility. Moreover, a photosensitive layer that contains fluorine-containing resin particles containing 0 or more and 30 or less carboxy groups per $10^6$ carbon atoms tends to have a low dielectric constant and residual potential remaining therein. To address these issues, the inventors have shown that adding a large amount of a fluorine-containing graft polymer that serves as a dispersing agent improves the dispersibility of the fluorine-containing resin particles, and, in addition, suppresses the increase in residual potential due to a high dielectric constant.

However, the fluorine-containing graft polymer that has separated free in the coating solution acts as a surfactant, increases the foaming property of the outermost surface layer-forming coating solution, and enhances the air bubble-stabilizing effect; thus, air bubbles that form defects tend to remain in the surface of the outermost surface layer.

Meanwhile, according to the photoreceptor of the first exemplary embodiment, by preparing an outermost surface layer-forming coating solution so that the contact angle of pure water on the outermost surface layer is within the aforementioned range, the surface tension of the outermost surface layer-forming coating solution can be decreased during manufacture of the outermost surface layer of the photoreceptor, and occurrence of air bubbles is suppressed. As a result, occurrence of air bubbles in the surface of the outermost surface layer of the photoreceptor of the first exemplary embodiment can be suppressed. In addition, although the details are not clear, the dielectric constant of the outermost surface layer is improved when the outermost surface layer of the photoreceptor contains a fluorine-containing graft polymer along with the fluorine-containing resin particles that has 0 or more and 30 or less carboxy groups per $10^6$ carbon atoms. When the dielectric constant of the outermost surface layer is adjusted to be within the aforementioned range, residual potential remaining in the photosensitive layer can be decreased.

Presumably thus, the photoreceptor of the first exemplary embodiment has a lower residual potential and less air bubbles in the surface of the outermost surface layer.

A photoreceptor according to a second exemplary embodiment includes a conductive substrate and a photosensitive layer on the conductive substrate, and the outermost surface layer of the photoreceptor contains fluorine-containing resin particles, a fluorine-containing graft polymer, and a defoaming agent.

Furthermore, the number of carboxy groups contained in the fluorine-containing resin particles is 0 or more and 30 or less per $10^6$ carbon atoms, the fluorine-containing graft polymer content relative to the fluorine-containing resin particle content is 4.5 mass % or more and 9.0 mass % or less, and the defoaming agent content relative to the outermost surface layer is 10 ppm (ppm is on a mass basis, the same applies hereinafter) or more and 10000 ppm or less.

The photoreceptor of the second exemplary embodiment has a lower residual potential and less air bubbles in the surface of the outermost surface layer because of the aforementioned features. The reason for this is presumably as follows.

As described above, the photosensitive layer that contains fluorine-containing resin particles containing 0 or more and 30 or less carboxy groups per $10^6$ carbon atoms tends to have bubbles in the surface of the outermost surface layer and residual potential remaining therein.

However, the photoreceptor of the second exemplary embodiment contains a fluorine-containing graft polymer and a defoaming agent along with the fluorine-containing resin particles. When the defoaming agent concentration relative to the outermost surface layer is 10 ppm or more and 10000 ppm or less, the surface tension of the outermost surface layer-forming coating solution can be decreased during manufacture of the outermost surface layer of the photoreceptor, and occurrence of air bubbles is suppressed even when the stirring force is increased. Furthermore, for example, the contact angle of pure water on the outermost surface layer tends to become 90° or more by adjusting the defoaming agent concentration in the outermost surface layer to be within the aforementioned range. As a result, occurrence of air bubbles remaining in the surface of the outermost surface layer of the photoreceptor of the second exemplary embodiment can be suppressed. Furthermore, although the details are not clear, the dielectric constant of the outermost surface layer tends to become 3.75 or more and 3.90 or less by adding, to the outermost surface layer of the photoreceptor, a fluorine-containing graft polymer at a concertation of 4.5 mass % or more and 9.0 mass % or less relative to the content of the fluorine-containing resin particles having 0 or more and 30 or less carboxy groups per $10^6$ carbon atoms.

Presumably thus, the photoreceptor of the second exemplary embodiment has a lower residual potential and less air bubbles in the surface of the outermost surface layer.

Hereinafter, a photoreceptor that corresponds to both the first and second exemplary embodiments (this photoreceptor may also be referred to as a "photoreceptor of the present exemplary embodiment") is described in detail. However, one example of the photoreceptor of the present disclosure may be a photoreceptor that corresponds to one of the photoreceptors of the first and second exemplary embodiments.

The electrophotographic photoreceptor of the present exemplary embodiment will now be described by referring to the drawings.

An electrophotographic photoreceptor 7A illustrated in FIG. 1 includes, for example, a conductive substrate 4, and an undercoat layer 1, a charge generating layer 2, and a charge transporting layer 3 that are stacked in this order on the conductive substrate 4. The charge generating layer 2 and the charge transporting layer 3 constitute a photosensitive layer 5.

The electrophotographic photoreceptor 7A may have a layer structure that does not include the undercoat layer 1.

The electrophotographic photoreceptor 7A may include a single-layer-type photosensitive layer in which the functions of the charge generating layer 2 and the charge transporting layer 3 are integrated. In the case of a photoreceptor having a single-layer-type photosensitive layer, the single-layer-type photosensitive layer constitutes the outermost surface layer.

Alternatively, the electrophotographic photoreceptor 7A may include a surface protection layer on the charge transporting layer 3 or a single-layer-type photosensitive layer. In the case of a photoreceptor having a surface protection layer, the surface protection layer constitutes the outermost surface layer.

The respective layers of the electrophotographic photoreceptor of the present exemplary embodiment will now be described in detail. In the description below, the reference signs are omitted.

Conductive Substrate

Examples of the conductive substrate include metal plates, metal drums, and metal belts that contain metals (aluminum, copper, zinc, chromium, nickel, molybdenum, vanadium, indium, gold, platinum, etc.) or alloys (stainless steel etc.). Other examples of the conductive substrate include paper sheets, resin films, and belts coated, vapor-deposited, or laminated with conductive compounds (for example, conductive polymers and indium oxide), metals (for example, aluminum, palladium, and gold), or alloys. Here, "conductive" means having a volume resistivity of less than $10^{13}$ Ωcm.

The surface of the conductive substrate may be roughened to a center-line average roughness Ra of 0.04 μm or more and 0.5 μm or less in order to suppress interference fringes that occur when the electrophotographic photoreceptor used in a laser printer is irradiated with a laser beam. When incoherent light is used as a light source, there is no need to roughen the surface to prevent interference fringes, but roughening the surface suppresses generation of defects due to irregularities on the surface of the conductive substrate and thus is desirable for extending the lifetime.

Examples of the surface roughening method include a wet honing method with which an abrasive suspended in water is sprayed onto a conductive support, a centerless grinding with which a conductive substrate is pressed against a rotating grinding stone to perform continuous grinding, and an anodization treatment.

Another example of the surface roughening method does not involve roughening the surface of a conductive substrate but involves dispersing a conductive or semi-conductive powder in a resin and forming a layer of the resin on a surface of a conductive substrate so as to create a rough surface by the particles dispersed in the layer.

The surface roughening treatment by anodization involves forming an oxide film on the surface of a conductive substrate by anodization by using a metal (for example, aluminum) conductive substrate as the anode in an electrolyte solution. Examples of the electrolyte solution include a sulfuric acid solution and an oxalic acid solution. However, a porous anodization film formed by anodization is chemically active as is, is prone to contamination, and has resistivity that significantly varies depending on the environment. Thus, a pore-sealing treatment may be performed on the porous anodization film so as to seal fine pores in the oxide film by volume expansion caused by hydrating reaction in pressurized steam or boiling water (a metal salt such as a nickel salt may be added) so that the oxide is converted into a more stable hydrous oxide.

The thickness of the anodization film may be, for example, 0.3 μm or more and 15 μm or less. When the thickness is within this range, a barrier property against injection tends to be exhibited, and the increase in residual potential caused by repeated use tends to be suppressed.

The conductive substrate may be subjected to a treatment with an acidic treatment solution or a Boehmite treatment.

The treatment with an acidic treatment solution is, for example, conducted as follows. First, an acidic treatment solution containing phosphoric acid, chromic acid, and hydrofluoric acid is prepared. The blend ratios of phosphoric acid, chromic acid, and hydrofluoric acid in the acidic treatment solution may be, for example, in the range of 10 mass % or more and 11 mass % or less for phosphoric acid, in the range of 3 mass % or more and 5 mass % or less for chromic acid, and in the range of 0.5 mass % or more and 2 mass % or less for hydrofluoric acid; and the total concentration of these acids may be in the range of 13.5 mass % or more and 18 mass % or less. The treatment temperature may be, for example, 42° C. or more and 48° C. or less. The thickness of the coating film may be 0.3 μm or more and 15 μm or less.

The Boehmite treatment is conducted by immersing a conductive substrate in pure water at 90° C. or higher and 100° C. or lower for 5 to 60 minutes or by bringing a conductive substrate into contact with heated steam at 90° C. or higher and 120° C. or lower for 5 to 60 minutes. The thickness of the coating film may be 0.1 μm or more and 5 μm or less. The Boehmite-treated body may be further anodized by using an electrolyte solution, such as adipic acid, boric acid, a borate salt, a phosphate salt, a phthalate salt, a maleate salt, a benzoate salt, a tartrate salt, or a citrate salt, that has low film-dissolving power.

Undercoat Layer

The undercoat layer is, for example, a layer that contains inorganic particles and a binder resin.

Examples of the inorganic particles include inorganic particles having a powder resistivity (volume resistivity) of $10^2$ Ωcm or more and $10^{11}$ Ωcm or less.

As the inorganic particles having this resistance value, for example, metal oxide particles such as tin oxide particles, titanium oxide particles, zinc oxide particles, or zirconium oxide particles are preferable, and, in particular, zinc oxide particles are preferable.

The specific surface area of the inorganic particles measured by the BET method may be, for example, 10 $m^2/g$ or more.

The volume-average particle diameter of the inorganic particles may be, for example, 50 nm or more and 2000 nm or less (or may be 60 nm or more and 1000 nm or less).

The amount of the inorganic particles contained relative to the binder resin is, for example, preferably 10 mass % or more and 80 mass % or less, and is more preferably 40 mass % or more and 80 mass % or less.

The inorganic particles may be surface-treated. A mixture of two or more inorganic particles subjected to different surface treatments or having different particle diameters may be used.

Examples of the surface treatment agent include a silane coupling agent, a titanate coupling agent, an aluminum coupling agent, and a surfactant. In particular, a silane coupling agent is preferable, and an amino-group-containing silane coupling agent is more preferable.

Examples of the amino-group-containing silane coupling agent include, but are not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane.

Two or more silane coupling agents may be mixed and used. For example, an amino-group-containing silane coupling agent may be used in combination with an additional silane coupling agent. Examples of this additional silane coupling agent include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

The surface treatment method that uses a surface treatment agent may be any known method, for example, may be a dry method or a wet method.

The treatment amount of the surface treatment agent may be, for example, 0.5 mass % or more and 10 mass % or less relative to the inorganic particles.

Here, the undercoat layer may contain inorganic particles and an electron-accepting compound (acceptor compound) from the viewpoints of improving long-term stability of electrical properties and carrier blocking properties.

Examples of the electron-accepting compound include electron transporting substances, such as quinone compounds such as chloranil and bromanil; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis (4-naphthyl)-1,3,4-oxadiazole, and 2,5-bis(4-diethylaminophenyl)-1,3,4-oxadiazole; xanthone compounds; thiophene compounds; and diphenoquinone compounds such as 3,3',5,5'-tetra-t-butyldiphenoquinone.

In particular, a compound having an anthraquinone structure may be used as the electron-accepting compound. Examples of the compound having an anthraquinone structure include hydroxyanthraquinone compounds, aminoanthraquinone compounds, and aminohydroxyanthraquinone compounds, and more specific examples thereof include anthraquinone, alizarin, quinizarin, anthrarufin, and purpurin.

The electron-accepting compound may be dispersed in the undercoat layer along with the inorganic particles, or may be attached to the surfaces of the inorganic particles.

Examples of the method for attaching the electron-accepting compound onto the surfaces of the inorganic particles include a dry method and a wet method.

The dry method is, for example, a method with which, while inorganic particles are stirred with a mixer or the like having a large shear force, an electron-accepting compound as is or dissolved in an organic solvent is added dropwise or sprayed along with dry air or nitrogen gas so as to cause the electron-accepting compound to attach to the surfaces of the inorganic particles. When the electron-accepting compound is added dropwise or sprayed, the temperature may be equal to or lower than the boiling point of the solvent. After the electron-accepting compound is added dropwise or sprayed, baking may be further conducted at 100° C. or higher. The temperature and time for baking are not particularly limited as long as the electrophotographic properties are obtained.

The wet method is, for example, a method with which, while inorganic particles are dispersed in a solvent by stirring, ultrasonically, or by using a sand mill, an attritor, or a ball mill, the electron-accepting compound is added, followed by stirring or dispersing, and then the solvent is removed to cause the electron-accepting compound to attach to the surfaces of the inorganic particles. The solvent is removed by, for example, filtration or distillation. After removing the solvent, baking may be further conducted at 100° C. or higher. The temperature and time for baking are not particularly limited as long as the electrophotographic properties are obtained. In the wet method, the moisture contained in the inorganic particles may be removed before adding the electron-accepting compound. For example, the moisture may be removed by stirring and heating the inorganic particles in a solvent or by boiling together with the solvent.

Attaching the electron-accepting compound may be conducted before, after, or simultaneously with the surface treatment of the inorganic particles by a surface treatment agent.

The amount of the electron-accepting compound contained relative to the inorganic particles may be, for example, 0.01 mass % or more and 20 mass % or less, and is preferably 0.01 mass % or more and 10 mass % or less.

Examples of the binder resin used in the undercoat layer include known materials such as known polymer compounds such as acetal resins (for example, polyvinyl butyral), polyvinyl alcohol resins, polyvinyl acetal resins, casein resins, polyamide resins, cellulose resins, gelatin, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenolic resins, phenol-formaldehyde resins, melamine resins, urethane resins, alkyd resins, and epoxy resins; zirconium chelate compounds; titanium chelate compounds; aluminum chelate compounds; titanium alkoxide compounds; organic titanium compounds; and silane coupling agents.

Other examples of the binder resin used in the undercoat layer include charge transporting resins that have charge transporting groups, and conductive resins (for example, polyaniline).

Among these, a resin that is insoluble in the coating solvent in the overlying layer is suitable as the binder resin used in the undercoat layer. Examples of the particularly suitable resin include thermosetting resins such as a urea resin, a phenolic resin, a phenol-formaldehyde resin, a melamine resin, a urethane resin, an unsaturated polyester resin, an alkyd resin, and an epoxy resin; and a resin obtained by a reaction between a curing agent and at least one resin selected from the group consisting of a polyamide resin, a polyester resin, a polyether resin, a methacrylic resin, an acrylic resin, a polyvinyl alcohol resin, and a polyvinyl acetal resin.

When two or more of these binder resins are used in combination, the mixing ratios are set as necessary.

The undercoat layer may contain various additives to improve electrical properties, environmental stability, and image quality.

Examples of the additives include known materials such as electron transporting pigments based on polycyclic condensed materials and azo materials, zirconium chelate compounds, titanium chelate compounds, aluminum chelate compounds, titanium alkoxide compounds, organic titanium compounds, and silane coupling agents. The silane coupling agent is used to surface-treat the inorganic particles as mentioned above, but may be further added as an additive to the undercoat layer.

Examples of the silane coupling agent that serves as an additive include vinyltrimethoxysilane, 3-methacryloxypropyl-tris(2-methoxyethoxy)silane, 2-(3,4-epoxycyclohexyl) ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

Examples of the zirconium chelate compounds include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetra-n-butyl titanate, butyl titanate dimer, tetra(2-ethylhexyl) titanate, titanium acetylacetonate, polytitanium acetylacetonate, titanium octylene glycolate, titanium lactate ammonium salt, titanium lactate, titanium lactate ethyl ester, titanium triethanol aminate, and polyhydroxy titanium stearate.

Examples of the aluminum chelate compounds include aluminum isopropylate, monobutoxyaluminum diisopropylate, aluminum butyrate, diethylacetoacetate aluminum diisopropylate, and aluminum tris(ethylacetoacetate).

These additives may be used alone, or two or more compounds may be used as a mixture or a polycondensation product.

The undercoat layer may have a Vickers hardness of 35 or more.

In order to suppress moire images, the surface roughness (ten-point average roughness) of the undercoat layer may be adjusted to be in the range of 1/(4 n) (n represents the refractive index of the overlying layer) to ½ of λ representing the laser wavelength used for exposure.

In order to adjust the surface roughness, resin particles and the like may be added to the undercoat layer. Examples of the resin particles include silicone resin particles and crosslinking polymethyl methacrylate resin particles. The surface of the undercoat layer may be polished to adjust the surface roughness. Examples of the polishing method included buff polishing, sand blasting, wet honing, and grinding.

The undercoat layer may be formed by any known method. For example, a coating film is formed by using an undercoat layer-forming solution prepared by adding the above-mentioned components to a solvent, dried, and, if needed, heated.

Examples of the solvent used for preparing the undercoat layer-forming solution include known organic solvents, such as alcohol solvents, aromatic hydrocarbon solvents, halogenated hydrocarbon solvents, ketone solvents, ketone alcohol solvents, ether solvents, and ester solvents.

Specific examples of the solvent include common organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of the method for dispersing inorganic particles in preparing the undercoat layer-forming solution include known methods that use a roll mill, a ball mill, a vibrating ball mill, an attritor, a sand mill, a colloid mill, and a paint shaker.

Examples of the method for applying the undercoat layer-forming solution to the conductive substrate include common methods such as a blade coating method, a wire bar coating method, a spray coating method, a dip coating method, a bead coating method, an air knife coating method, and a curtain coating method.

The thickness of the undercoat layer is preferably set within the range of 15 μm or more, and more preferably within the range of 20 μm or more and 50 μm or less.

Intermediate Layer

Although not illustrated in the drawings, an intermediate layer may be further provided between the undercoat layer and the photosensitive layer.

The intermediate layer is, for example, a layer that contains a resin. Examples of the resin used in the intermediate layer include polymer compounds such as acetal resins (for example, polyvinyl butyral), polyvinyl alcohol resins, polyvinyl acetal resins, casein resins, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may contain an organic metal compound. Examples of the organic metal compound used in the intermediate layer include organic metal compounds containing metal atoms such as zirconium, titanium, aluminum, manganese, and silicon.

These compounds used in the intermediate layer may be used alone, or two or more compounds may be used as a mixture or a polycondensation product.

In particular, the intermediate layer may be a layer that contains an organic metal compound that contains zirconium atoms or silicon atoms.

The intermediate layer may be formed by any known method. For example, a coating film is formed by using an intermediate layer-forming solution prepared by adding the above-mentioned components to a solvent, dried, and, if needed, heated.

Examples of the application method for forming the intermediate layer include common methods such as a dip coating method, a lift coating method, a wire bar coating method, a spray coating method, a blade coating method, a knife coating method, and a curtain coating method.

The thickness of the intermediate layer may be set within the range of, for example, 0.1 μm or more and 3 μm or less. The intermediate layer may be used as the undercoat layer.

Charge Generating Layer

The charge generating layer is, for example, a layer that contains a charge generating material and a binder resin. The charge generating layer may be a vapor deposited layer of a charge generating material. The vapor deposited layer of the charge generating material may be used when an incoherent light such as a light emitting diode (LED) or an organic electro-luminescence (EL) image array is used.

Examples of the charge generating material include azo pigments such as bisazo and trisazo pigments; fused-ring aromatic pigments such as dibromoanthanthrone; perylene pigments; pyrrolopyrrole pigments; phthalocyanine pigments; zinc oxide; and trigonal selenium.

Among these, in order to be compatible to the near-infrared laser exposure, a metal phthalocyanine pigment or a metal-free phthalocyanine pigment may be used as the charge generating material. Specific examples thereof include hydroxygallium phthalocyanine disclosed in Japanese Unexamined Patent Application Publication Nos. 5-263007 and 5-279591; chlorogallium phthalocyanine disclosed in Japanese Unexamined Patent Application Publication No. 5-98181; dichlorotin phthalocyanine disclosed in Japanese Unexamined Patent Application Publication Nos. 5-140472 and 5-140473; and titanyl phthalocyanine disclosed in Japanese Unexamined Patent Application Publication No. 4-189873.

In order to be compatible to the near ultraviolet laser exposure, the charge generating material may be a fused-ring aromatic pigment such as dibromoanthanthrone, a thioindigo pigment, a porphyrazine compound, zinc oxide, trigonal selenium, a bisazo pigment disclosed in Japanese Unexamined Patent Application Publication Nos. 2004-78147 and 2005-181992, or the like.

When an incoherent light source, such as an LED or an organic EL image array having an emission center wavelength in the range of 450 nm or more and 780 nm or less, is used, the charge generating material described above may be used; however, from the viewpoint of the resolution, when the photosensitive layer is as thin as 20 μm or less, the electric field intensity in the photosensitive layer is increased, charges injected from the substrate are decreased, and image defects known as black spots tend to occur. This is particularly noticeable when a charge generating material, such as trigonal selenium or a phthalocyanine pigment, that is of a p-conductivity type and easily generates dark current is used.

In contrast, when an n-type semiconductor, such as a fused-ring aromatic pigment, a perylene pigment, or an azo pigment, is used as the charge generating material, dark current rarely occurs and, even when the thickness is small, image defects known as black spots can be suppressed. Examples of the n-type charge generating material include, but are not limited to, compounds (CG-1) to (CG-27) described in Japanese Unexamined Patent Application Publication No. 2012-155282, paragraphs [0288] to [0291].

Whether n-type or not is determined by a time-of-flight method commonly employed, on the basis of the polarity of the photocurrent flowing therein. A material in which electrons flow more smoothly as carriers than holes is determined to be of an n-type.

The binder resin used in the charge generating layer is selected from a wide range of insulating resins. Alternatively, the binder resin may be selected from organic photoconductive polymers, such as poly-N-vinylcarbazole, polyvinyl anthracene, polyvinyl pyrene, and polysilane.

Examples of the binder resin include, polyvinyl butyral resins, polyarylate resins (polycondensates of bisphenols and aromatic dicarboxylic acids etc.), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. Here, "insulating" means having a volume resistivity of $10^{13}$ Ωcm or more.

These binder resins are used alone or in combination as a mixture.

The blend ratio of the charge generating material to the binder resin may be in the range of 10:1 to 1:10 on a mass ratio basis.

The charge generating layer may contain other known additives.

The charge generating layer may be formed by any known method. For example, a coating film is formed by using an charge generating layer-forming solution prepared by adding the above-mentioned components to a solvent, dried, and, if needed, heated. The charge generating layer may be formed by vapor-depositing a charge generating material. The charge generating layer may be formed by vapor deposition particularly when a fused-ring aromatic pigment or a perylene pigment is used as the charge generating material.

Specific examples of the solvent for preparing the charge generating layer-forming solution include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents are used alone or in combination as a mixture.

In order to disperse particles (for example, the charge generating material) in the charge generating layer-forming solution, a media disperser such as a ball mill, a vibrating ball mill, an attritor, a sand mill, or a horizontal sand mill, or a media-less disperser such as stirrer, an ultrasonic disperser, a roll mill, or a high-pressure homogenizer can be used. Examples of the high-pressure homogenizer include a collision-type homogenizer in which the dispersion in a high-pressure state is dispersed through liquid-liquid collision or liquid-wall collision, and a penetration-type homogenizer in which the fluid in a high-pressure state is caused to penetrate through fine channels.

In dispersing, it is effective to set the average particle diameter of the charge generating material in the charge generating layer-forming solution to 0.5 μm or less, preferably 0.3 μm or less, and more preferably 0.15 μm or less.

Examples of the method for applying the charge generating layer-forming solution to the undercoat layer (or the intermediate layer) include common methods such as a blade coating method, a wire bar coating method, a spray coating method, a dip coating method, a bead coating method, an air knife coating method, and a curtain coating method.

The thickness of the charge generating layer is preferably set within the range of, for example, 0.1 μm or more and 5.0 μm or less, and more preferably within the range of 0.2 μm or more and 2.0 μm or less.

Charge Transporting Layer

The charge transporting layer is, for example, a layer that contains a charge transporting material and a binder resin. The charge transporting layer may be a layer that contains a polymer charge transporting material.

When the charge transporting layer is the outermost surface layer, the charge transporting layer contains, in addition to a binder resin and a charge transporting material, fluorine-containing resin particles, a fluorine-containing graft polymer, and a defoaming agent.

When another layer (for example, a protective layer or the like) is disposed on the charge transporting layer and thus the charge transporting layer is not the outermost surface layer, the charge transporting layer is to contain at least a binder resin and a charge transporting material, and may contain other additives if needed. The binder resin, the charge transporting material, and other additives are the same as when the charge transporting layer is the outermost surface layer.

The components contained in the charge transporting layer that serves as the outermost surface layer are described below.

Binder Resin

Examples of the binder resin used in the charge transporting layer include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinylcarbazole, and polysilane. Among these, a polycarbonate resin or a polyarylate resin may be used as the binder resin. These binder resins are used alone or in combination.

The blend ratio of the charge transporting material to the binder resin may be in the range of 10:1 to 1:5 on a mass ratio basis.

The binder resin content relative to the total solid content of the photosensitive layer (charge transporting layer) is, for example, preferably 10 mass % or more and 90 mass % or less, more preferably 30 mass % or more and 90 mass % or less, and yet more preferably 50 mass % or more and 90 mass % or less.

Charge Transporting Material

Examples of the charge transporting material include electron transporting compounds such as quinone compounds such as p-benzoquinone, chloranil, bromanil, and anthraquinone; tetracyanoquinodimethane compounds; fluorenone compounds such as 2,4,7-trinitrofluorenone; xanthone compounds; benzophenone compounds; cyanovinyl compounds; and ethylene compounds. Other examples of the charge transporting material include hole transporting compounds such as triarylamine compounds, benzidine compounds, aryl alkane compounds, aryl-substituted ethylene compounds, stilbene compounds, anthracene compounds, and hydrazone compounds. These charge transporting materials may be used alone or in combination, but are not limiting.

From the viewpoint of charge mobility, the charge transporting material may be a triaryl amine derivative represented by structural formula (a-1) below or a benzidine derivative represented by structural formula (a-2) below.

(a-1)

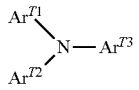

In structural formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$, or $—C_6H_4—CH=CH—CH=C(R^{T7})(R^{T8})$. $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

Examples of the substituent for each of the groups described above include a halogen atom, an alkyl group having 1 to 5 carbon atoms, and an alkoxy group having 1 to 5 carbon atoms. Examples of the substituent for each of the groups described above include a substituted amino group substituted with an alkyl group having 1 to 3 carbon atoms.

(a-2)

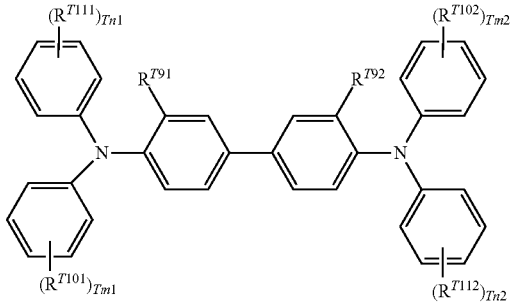

In structural formula (a-2), $R^{T91}$ and $R^{T92}$ each independently represent a hydrogen atom, a halogen atom, an alkyl group having 1 to 5 carbon atoms, or an alkoxy group having 1 to 5 carbon atoms. $R^{T101}$, $R^{T102}$, $R^{T111}$, and $R^{T112}$ each independently represent a halogen atom, an alkyl group having 1 to 5 carbon atoms, an alkoxy group having 1 to 5 carbon atoms, an amino group substituted with an alkyl group having 1 or 2 carbon atoms, a substituted or unsubstituted aryl group, $—C(R^{T12})=C(R^{T13})(R^{T14})$, or $—CH=CH—CH=C(R^{15})(R^{T16})$; and $R^{T12}$, $R^{T1}$, $R^{T14}$, $R^{T15}$, and $R^{T16}$ each independently represent a hydrogen atom, a substituted or unsubstituted alkyl group, or a substituted or unsubstituted aryl group. Tm1, Tm2, Tn1, and Tn2 each independently represent an integer of 0 or more and 2 or less.

Examples of the substituent for each of the groups described above include a halogen atom, an alkyl group having 1 to 5 carbon atoms, and an alkoxy group having 1 to 5 carbon atoms. Examples of the substituent for each of the groups described above include a substituted amino group substituted with an alkyl group having 1 to 3 carbon atoms.

Here, among the triarylamine derivatives represented by structural formula (a-1) and the benzidine derivatives represented by structural formula (a-2) above, a triarylamine derivative having $—C_6H_4—CH=CH—CH=C(R^{T7})(R^{T8})$ or a benzidine derivative having $—CH=CH—CH=C(R^{T15})(R^{T16})$ may be used from the viewpoint of the charge mobility.

Examples of the polymer charge transporting material that can be used include known charge transporting materials such as poly-N-vinylcarbazole and polysilane. In particular, polyester polymer charge transporting materials disclosed in Japanese Unexamined Patent Application Publication Nos. 8-176293 and 8-208820 are particularly preferable. The polymer charge transporting material may be used alone or in combination with a binder resin.

Fluorine-Containing Resin Particles

Examples of the fluorine-containing resin particles include particles of a fluoroolefin homopolymer, and particles of a copolymer of two or more monomers which are at least one fluoroolefin monomer and a non-fluorine monomer (monomer free of fluorine atoms).

Examples of the fluoroolefin include perhaloolefins such as tetrafluoroethylene (TFE), perfluorovinylether, hexafluoropropylene (HFP), and chlorotrifluoroethylene (CTFE), and non-perfluoroolefins such as vinylidene fluoride (VdF), trifluoroethylene, and vinyl fluoride. Among these, VdF, TFE, CTFE, HFP, or the like may be used.

Examples of the non-fluorine monomers include hydrocarbon olefins such as ethylene, propylene and butene; alkyl vinyl ethers such as cyclohexyl vinyl ether (CHVE), ethyl vinyl ether (EVE), butyl vinyl ether, and methyl vinyl ether; alkenyl vinyl ethers such as polyoxyethylene allyl ether (POEAE) and ethyl allyl ether; organosilicon compounds having a reactive, α, β-unsaturated group such as vinyltrimethoxysilane (VSi), vinyltriethoxysilane, and vinyltris (methoxyethoxy)silane; acrylic esters such as methyl acrylate and ethyl acrylate; methacrylic esters such as methyl methacrylate and ethyl methacrylate; and vinyl esters such as vinyl acetate, vinyl benzoate, and "Beova" (trade name, vinyl ester manufactured by Shell). Among these, alkyl vinyl ether, allyl vinyl ether, vinyl ester, and an organosilicon compound having a reactive α, β-unsaturated group may be used.

Among these, particles having a high fluorination ratio may be used as the fluorine-containing resin particles. Particles of polytetrafluoroethylene (PTFE), a tetrafluoroethylene-hexafluoropropylene copolymer (FEP), a tetrafluoroethylene-perfluoro(alkyl vinyl ether) copolymer (PFA), an ethylene-tetrafluoroethylene copolymer (ETFE), an ethylene, chlorotrifluoroethylene copolymer (ECTFE), and the like are more preferable, and particles of PTFE, FEP, and PFA are particularly preferable.

The number of carboxy groups in the fluorine-containing resin particles is 0 or more and 30 or less per $10^6$ carbon atoms.

When the number of carboxy groups in the fluorine-containing resin particles is within the aforementioned range, the chargeability can be improved.

The number of carboxy groups in the fluorine-containing resin particles may be 0 or more and 20 or less from the viewpoint of improving the chargeability.

The carboxy groups in the fluorine-containing resin particle are, for example, carboxy groups derived from the terminal carboxylic acid contained in the fluorine-containing resin particle.

Examples of the method for reducing the number of carboxy groups in the fluorine-containing resin particle include 1) a method that does not apply radiation during the process of producing particles, and 2) a method in which irradiation is performed in the absence of oxygen or under a reduced oxygen concentration condition.

The number of carboxy groups in the fluorine-containing resin particles is measured as follows according to the disclosure in Japanese Unexamined Patent Application Publication No. 4-20507, for example.

Fluorine-containing resin particles are pre-formed by a pressing machine into a film having a thickness of about 0.1 mm. An infrared absorption spectrum of the prepared film is measured. An infrared absorption spectrum of fluorine-containing resin particles in which carboxylic acid terminals are completely fluorinated by allowing the fluorine-containing resin particles to contact fluorine gas is also measured, and the number of terminal carboxy groups is determined from the following formula from the difference between the two spectra:

$$\text{number of groups (per } 10^6 \text{ carbon atoms)} = (l \times K)/t$$

l: absorbance

K: correction factor t: thickness (mm) of film

The absorption wavenumber of the carboxy group is assumed to be 3560 $cm^{-1}$, and the correction factor is assumed to be 440.

Examples of the fluorine-containing resin particles include particles obtained by radiation irradiation (in this description, also referred to as the "irradiated fluorine-containing resin particles") and particles obtained by polymerization (in this description, also referred to as the "polymerized fluorine-containing resin particles").

The irradiated fluorine-containing resin particles (the fluorine-containing resin particles obtained by irradiation with radiation) refer to fluorine-containing resin particles that have been given a particle form during radiation polymerization, and fluorine-containing resin particles obtained by irradiating a polymerized fluorine-containing resin with radiation so as to decompose the resin to reduce the molecular weight and to give a particle form.

The irradiated fluorine-containing resin particles contain many carboxy groups since large quantities of carboxylic acids occur by irradiation in air.

Meanwhile, polymerized fluorine-containing resin particles (fluorine-containing resin particles obtained by polymerization) refer to fluorine-containing resin particles that have become particles during polymerization such as suspension polymerization or emulsion polymerization and that are not irradiated with radiation.

The fluorine-containing resin particles may be polymerized fluorine-containing resin particles. As mentioned above, the polymerized fluorine-containing resin particles are formed into particles during polymerization such as suspension polymerization or emulsion polymerization, and are not irradiated.

An example of the method for preparing fluorine-containing resin particles by suspension polymerization involves suspending, in a dispersion medium, a monomer that forms a fluorine-containing resin, and additives such as a polymerization initiator and a catalyst, and then forming particles of a polymer while polymerizing the monomer.

An example of the method for preparing fluorine-containing resin particles by emulsion polymerization involves emulsifying, in a dispersion medium, a monomer that forms a fluorine-containing resin, and additives such as a polymerization initiator and a catalyst by using a surfactant (namely, an emulsifier), and then forming particles of a polymer while polymerizing the monomer.

In particular, the fluorine-containing resin particles may be particles obtained without irradiation in the production process.

However, irradiated fluorine-containing resin particles that have been irradiated with radiation in the absence of oxygen or under a reduced oxygen concentration condition may be used as the fluorine-containing resin particles.

The average particle diameter of the fluorine-containing resin particles is not particularly limited, but is preferably 0.2 μm or more and 4.5 μm or less and more preferably 0.2 μm or more and 4 μm or less.

The average particle diameter of the fluorine-containing resin particles is the value measured by the following method.

Using a scanning electron microscope (SEM), particles are observed at a magnification of, for example, 5000× or more, the maximum diameters of the fluorine-containing resin particles (secondary particles formed by agglomeration of primary particles) are measured, and the average of fifty particles is used as the average particle diameter of the fluorine-containing resin particles. The SEM used is JSM-6700F produced by JEOL Ltd., and a secondary electron image at an accelerating voltage of 5 kV is observed.

The specific surface area (BET specific surface area) of the fluorine-containing resin particles is preferably 5 $m^2/g$ or more and 15 $m^2/g$ or less and more preferably 7 $m^2/g$ or more and 13 $m^2/g$ or less from the viewpoint of dispersion stability.

The specific surface area is a value measured by a BET-type specific surface area meter (FlowSorb II2300 produced by Shimadzu Corporation) by a nitrogen substitution method.

The apparent density of the fluorine-containing resin particles is preferably 0.2 g/ml or more and 0.5 g/ml or less and more preferably 0.3 g/ml or more and 0.45 g/ml or less from the viewpoint of dispersion stability.

The apparent density is a value measured in accordance with JIS K 6891 (1995).

The melting temperature of the fluorine-containing resin particles is preferably 300° C. or more and 340° C. or less and more preferably 325° C. or more and 335° C. or less.

The melting temperature is a melting temperature measured in accordance with JIS K 6891 (1995).

The fluorine-containing resin particle content relative to the outermost surface layer is preferably 1 mass % or more and 20 mass % or less, more preferably 5 mass % or more and 15 mass % or less, and yet more preferably 7 mass % or more and 10 mass % or less.

Fluorine-Containing Graft Polymer

A fluorine-containing graft polymer is a dispersing agent that contains fluorine atoms.

Examples of the fluorine-containing graft polymer include polymers obtained by homopolymerization or copolymerization of polymerizable compounds having fluorinated alkyl groups (hereinafter these polymers may be referred to as "fluorinated alkyl group-containing polymers").

Specific examples of the fluorine-containing graft polymer include homopolymers of (meth)acrylates having fluorinated alkyl groups, and random or block copolymers obtained from (meth)acrylates having fluorinated alkyl groups and fluorine atom-free monomers. Note that (meth) acrylates refer to both acrylates and methacrylates.

Examples of the (meth)acrylates having fluorinated alkyl groups include 2,2,2-trifluoroethyl (meth)acrylate and 2,2,3,3,3-pentafluoropropyl (meth) acrylate.

Examples of the fluorine atom-free monomers include (meth)acrylate, isobutyl (meth)acrylate, t-butyl (meth)acrylate, isooctyl (meth)acrylate, lauryl (meth)acrylate, stearyl (meth)acrylate, isobornyl (meth) acrylate, cyclohexyl (meth) acrylate, 2-methoxyethyl (meth)acrylate, methoxytriethylene glycol (meth)acrylate, 2-ethoxyethyl (meth)acrylate, tetrahydrofurfuryl (meth)acrylate, benzyl (meth)acrylate, ethylcarbitol (meth) acrylate, phenoxyethyl (meth)acrylate, 2-hydroxy (meth)acrylate, 2-hydroxypropyl (meth)acrylate, 4-hydroxybutyl (meth)acrylate, methoxypolyethylene glycol (meth)acrylate, phenoxypolyethylene glycol (meth)acrylate, hydroxyethyl-o-phenylphenol (meth)acrylate, and o-phenylphenol glycidyl ether (meth)acrylate.

Other specific examples of the fluorine-containing graft polymer include block or branched polymers disclosed in the U.S. Pat. No. 5,637,142 and Japanese Patent No. 4251662. Other specific examples of the fluorine-containing graft polymer include fluorine surfactants.

Among these, the fluorine-containing graft polymer is preferably a fluorinated alkyl group-containing polymer having a structural unit represented by general formula (FA) below and is more preferably a fluorinated alkyl group-containing polymer having a structural unit represented by general formula (FA) below and a structural unit represented by general formula (FB) below.

In the description below, the fluorinated alkyl group-containing polymer having a structural unit represented by general formula (FA) below and a structural unit represented by general formula (FB) below is described.

(FA)

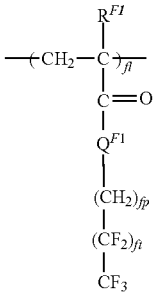

(FB)

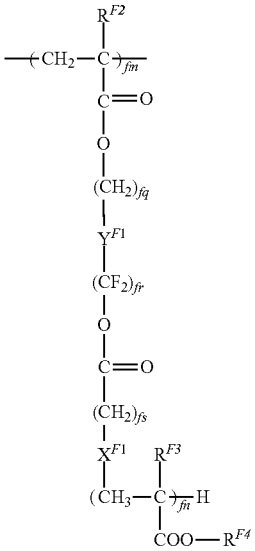

In general formulae (FA) and (FB), $R^{F1}$, $R^{F2}$, $R^{R3}$, and $R^{F4}$ each independently represent a hydrogen atom or an alkyl group, $X^{F1}$ represents an alkylene chain, a halogen-substituted alkylene chain, —S—, —O—, —NH—, or a single bond, $Y^{F1}$ represents an alkylene chain, a halogen-substituted alkylene chain, —($C_{fx}H_{2fx-1}$(OH))—, or a single bond, $Q^{F1}$ represents —O— or —NH—, fl, fm, and fn each independently represent an integer of 1 or more, fp, fq, fr, and fs each independently represent 0 or an integer of 1 or more, ft represents an integer of 1 or more and 7 or less, and fx represents an integer of 1 or more.

In general formulae (FA) and (FB), a hydrogen atom, a methyl group, an ethyl group, a propyl group, etc., are preferable as the groups represented by $R^{F1}$, $R^{F2}$, $R^{F3}$, and $R^{F4}$. A hydrogen atom and a methyl group are more preferable, and a methyl group is yet more preferable.

In general formulae (FA) and (FB), linear or branched alkylene chains having 1 to 10 carbon atoms may be used as the alkylene chains (unsubstituted alkylene chains and halogen-substituted alkylene chains) represented by $X^{F1}$ and $Y^{F1}$.

In —($C_{fx}H_{2fx-1}$(OH))— represented by $Y^{F1}$, fx may represent an integer of 1 or more and 10 or less.

Furthermore, fp, fq, fr, and fs may each independently represent 0 or an integer of 1 or more and 10 or less.

For example, fn may be 1 or more and 60 or less.

Here, in the fluorine-containing graft polymer, the ratio of the structural unit represented by general formula (FA) to the structural unit represented by general formula (FB), in other words, fl:fm, is preferably in the range of 1:9 to 9:1 and more preferably in the range of 3:7 to 7:3.

The fluorine-containing graft polymer may further contain a structural unit represented by general formula (FC) in addition to the structural unit represented by general formula (FA) and the structural unit represented by general formula (FB). The content ratio (fl+fm:fz) of the total (fl+fm) of the structural units represented by general formulae (FA) and (FB) to the structural unit represented by general formula (FC) is preferably in the range of 10:0 to 7:3 and is more preferably in the range of 9:1 to 7:3.

(FC)

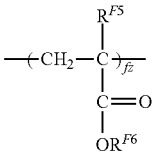

In general formula (FC), $R^{F5}$ and $R^{F6}$ each independently represent a hydrogen atom or an alkyl group. Furthermore, fz represents an integer of 1 or more.

In general formula (FC), a hydrogen atom, a methyl group, an ethyl group, a propyl group, etc., may be used as the groups represented by $R^{F5}$ and $R^{F6}$. A hydrogen atom and a methyl group are more preferable, and a methyl group is yet more preferable.

Examples of the commercially available products of the fluorine-containing graft polymer include GF300 and GF400 (produced by Toagosei Co, Ltd.), Surflon series (produced by AGC SEIMI CHEMICAL CO., LTD.), Ftergent series (produced by NEOS Company Limited), PF series (produced by Kitamura Chemicals Co., Ltd.), Megaface series (produced by DIC Corporation), and FC series (produced by 3M).

The weight-average molecular weight Mw of the fluorine-containing graft polymer is preferably 20,000 or more and 200,000 or less and more preferably 50,000 or more and 200,000 or less from the viewpoint of improving the dispersibility of the fluorine-containing resin particles.

The weight-average molecular weight of the fluorine-containing graft polymer is a value measured by gel permeation chromatography (GPC). The molecular weight measurement by GPC is conducted by, for example, using GPC.HLC-8120 produced by TOSOH CORPORATION as a measurement instrument with TSKgel GMHHR-M+TSKgel GMHHR-M columns (7.8 mm I.D., 30 cm) produced by TOSOH CORPORATION and a chloroform solvent, and calculating the molecular weight from the measurement results by using a molecular weight calibration curve prepared from a monodisperse polystyrene standard sample.

The fluorine-containing graft polymer content relative to the fluorine-containing resin particle content is 4.5 mass % or more and 9.0 mass % or less.

When the fluorine-containing graft polymer content is within the aforementioned range, the dielectric constant of the photosensitive layer is improved.

From the viewpoint of improving the dielectric constant of the photosensitive layer, the fluorine-containing graft polymer content relative to the fluorine-containing resin particle content may be 5 mass % or more and 6 mass % or less.

The fluorine-containing graft polymers may be used alone or in combination.

Defoaming Agent

Examples of the defoaming agent include silicone defoaming agents, fluorine defoaming agents, polyether defoaming agents, and aliphatic acid ester defoaming agents. These defoaming agents may be used alone or in combination.

Examples of the silicone defoaming agents include dimethyl silicone, methyl hydrogen silicone, and organo-modified silicone.

Examples of the fluorine defoaming agents include fluorine-modified silicone (fluorosilicone), perfluoropolyether, perfluoroalkyl sulfonate, perfluoroalkyl carboxylate, perfluoroalkyl phosphate, perfluoroalkyl betaine, and perfluoroalkylamine oxide compounds.

Examples of the polyether defoaming agents include polyoxyalkylene glycol monoalkyl (or alkenyl) ethers obtained by adding ethylene oxide or propylene oxide to an aliphatic alcohol having 16 to 20 carbon atoms.

Examples of the aliphatic acid ester defoaming agents include glycerin monoricinolate, alkenyl succinic acid derivatives, sorbitol monolaurate, and sorbitol trioleate.

From the viewpoint of suppressing occurrence of air bubbles in the surface of the outermost surface layer, the defoaming agent may be at least one defoaming agent selected from dimethylpolysiloxane and fluorine defoaming agents, and is more preferably dimethylpolysiloxane.

The defoaming agent content relative to the outermost surface layer is 10 ppm or more and 10000 ppm or less.

When the defoaming agent content relative to the outermost surface layer is 10 ppm or more and 10000 ppm or less, the surface tension of the outermost surface layer-forming coating solution can be decreased during manufacture of the outermost surface layer, and occurrence of air bubbles is suppressed.

From the viewpoint of suppressing occurrence of air bubbles in the surface of the outermost surface layer, the defoaming agent content relative to the outermost surface layer is preferably 10 ppm or more and 5000 ppm or less and more preferably 100 ppm or more and 5000 ppm or less.

From the viewpoint of suppressing occurrence of air bubbles in the surface of the outermost surface layer, the defoaming agent content relative to the fluorine-containing resin particle content is preferably 0.01 mass % or more and 15 mass % or less and more preferably 0.01 mass % or more and 10 mass % or less.

Dielectric Constant of Outermost Surface Layer

The outermost surface layer of the photoreceptor of the present exemplary embodiment has a dielectric constant of 3.75 or more and 3.90 or less.

When the dielectric constant of the outermost surface layer is 3.75 or more and 3.90 or less, the dielectric constant of the photosensitive layer is improved, and the residual potential remaining therein is suppressed.

In order to set the dielectric constant of the outermost surface layer to be within the aforementioned range, the fluorine-containing graft polymer content relative to the fluorine-containing resin particle content may be 4.5 mass % or more and 9.0 mass % or less.

From the viewpoints of improving the dielectric constant of the photosensitive layer and suppressing the residual potential remaining therein, the dielectric constant of the outermost surface layer is preferably 3.77 or more and 3.90 or less and more preferably 3.80 or more and 3.90 or less.

Measurement of the dielectric constant of the outermost surface layer will now be described.

A plate-shaped sample is obtained from a measurement subject layer of the electrophotographic photoreceptor. The plate-shaped sample is sandwiched between a gold electrode and an aluminum plate to prepare a cell. This cell is subjected to AC-applied resistance and capacitance measurement with Impedance Analyzer produced by Solartron Analytical, and then the dielectric constant is calculated. The measurement conditions are as follows.

Measurement frequency band: 1000000 Hz to 0.001 Hz

Bias voltage: 0 V

Applied peak AC field: 0.2 V/μm

Measurement environment: 30° C., 85% RH

Contact Angle of Pure Water on Outermost Surface Layer

The contact angle of the pure water on the outermost surface layer of the photoreceptor of the exemplary embodiment is 90° or more.

By preparing an outermost surface layer-forming coating solution so that the contact angle of pure water on the outermost surface layer is 90° or more, the surface tension of the outermost surface layer-forming coating solution can be decreased during manufacture of the outermost surface layer, and occurrence of air bubbles in the outermost surface layer is suppressed.

In order to set the contact angle of pure water on the outermost surface layer to be within the aforementioned range, the defoaming agent content in the outermost surface layer relative to the outermost surface layer may be 10 ppm or more and 10000 ppm or less.

From the viewpoint of suppressing occurrence of air bubbles in the surface of the outermost surface layer, the contact angle of pure water on the outermost surface layer is preferably 95° or more and 120° or less and more preferably 100° or more and 110° or less.

The contact angle of pure water on the outermost surface layer is measured with a contact angle meter (CA-X produced by Kyowa Interface Science, Inc.) in an environment having a temperature of 25° C. and a humidity of 50% by dropping 3.1 μl of pure water onto a horizontally placed outermost surface layer, taking image of the droplet with an optical microscope 15 seconds after dropping, and then calculating the contact angle θ of pure water from the image.

The charge transporting layer may contain other known additives.

The charge transporting layer may be formed by any known method. For example, the charge transporting layer is formed by preparing a charge transporting layer-forming solution containing the aforementioned components and a solvent, forming a coating film by using the solution, and drying and, if needed, heating the coating film.

Examples of the solvent used to prepare the charge transporting layer-forming solution include common organic solvents such as aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic or linear ethers such as tetrahydrofuran and ethyl ether. These solvents are used alone or in combination as a mixture.

Examples of the method for applying the charge transporting layer-forming solution to the charge generating layer include common methods such as a blade coating method, a wire bar coating method, a spray coating method, a dip coating method, a bead coating method, an air knife coating method, and a curtain coating method.

The thickness of the charge transporting layer is preferably set within the range of, for example, 5 μm or more and 50 μm or less, and more preferably within the range of 10 μm or more and 30 μm or less.

Protective Layer

A protective layer is disposed on a photosensitive layer if necessary. The protective layer is, for example, formed to avoid chemical changes in the photosensitive layer during charging and further improve the mechanical strength of the photosensitive layer.

Thus, the protective layer may be a layer formed of a cured film (crosslinked film). Examples of such a layer include layers indicated in 1) and 2) below.

1) A layer formed of a cured film of a composition that contains a reactive-group-containing charge transporting material having a reactive group and a charge transporting skeleton in the same molecule (in other words, a layer that contains a polymer or crosslinked body of the reactive-group-containing charge transporting material).

2) A layer formed of a cured film of a composition that contains a non-reactive charge transporting material, and a reactive-group-containing non-charge transporting material that does not have a charge transporting skeleton but has a reactive group (in other words, a layer that contains a polymer or crosslinked body of the non-reactive charge transporting material and the reactive-group-containing non-charge transporting material).

Examples of the reactive group contained in the reactive-group-containing charge transporting material include known reactive groups such as chain-polymerizable groups, an epoxy group, —OH, —OR (where R represents an alkyl group), —$NH_2$, —SH, —COOH, and —$SiR^{Q1}{}_{3-Qn}(OR^{Q2})_{Qn}$ (where $R^{Q1}$ represents a hydrogen atom, an alkyl group, or a substituted or unsubstituted aryl group, $R^{Q2}$ represents a hydrogen atom, an alkyl group, or a trialkylsilyl group, and Qn represents an integer of 1 to 3).

The chain-polymerizable group may be any radical-polymerizable functional group, and an example thereof is a functional group having a group that contains at least a carbon-carbon double bond. A specific example thereof is a group that contains at least one selected from a vinyl group, a vinyl ether group, a vinyl thioether group, a styryl group (vinylphenyl group), an acryloyl group, a methacryloyl group, and derivatives thereof. Among these, the chain-polymerizable group may be a group that contains at least one selected from a vinyl group, a styryl group (vinylphenyl group), an acryloyl group, a methacryloyl group, and derivatives thereof due to their excellent reactivity.

The charge transporting skeleton of the reactive-group-containing charge transporting material may be any known structure used in the electrophotographic photoreceptor, and examples thereof include skeletons that are derived from nitrogen-containing hole transporting compounds, such as triarylamine compounds, benzidine compounds, and hydrazone compounds, and that are conjugated with nitrogen atoms. Among these, a triarylamine skeleton is preferable.

The reactive-group-containing charge transporting material that has such a reactive group and a charge transporting skeleton, the non-reactive charge transporting material, and the reactive-group-containing non-charge transporting material may be selected from among known materials.

The protective layer may contain other known additives.

The protective layer may be formed by any known method. For example, a coating film is formed by using a protective layer-forming solution prepared by adding the above-mentioned components to a solvent, dried, and, if needed, cured such as by heating.

Examples of the solvent used to prepare the protective layer-forming solution include aromatic solvents such as toluene and xylene, ketone solvents such as methyl ethyl ketone, methyl isobutyl ketone, and cyclohexanone, ester solvents such as ethyl acetate and butyl acetate, ether solvents such as tetrahydrofuran and dioxane, cellosolve solvents such as ethylene glycol monomethyl ether, and alcohol solvents such as isopropyl alcohol and butanol. These solvents are used alone or in combination as a mixture.

The protective layer-forming solution may be a solvent-free solution.

Examples of the application method used to apply the protective layer-forming solution onto the photosensitive layer (for example, the charge transporting layer) include common methods such as a dip coating method, a lift coating method, a wire bar coating method, a spray coating method, a blade coating method, a knife coating method, and a curtain coating method.

The thickness of the protective layer is preferably set within the range of, for example, 1 μm or more and 20 μm or less, and more preferably within the range of 2 μm or more and 10 μm or less.

Single-Layer-Type Photosensitive Layer

The single-layer-type photosensitive layer (charge generating/charge transporting layer) is, for example, a layer that contains a charge generating material, a charge transporting material, and, optionally, a binder resin and other known additives. These materials are the same as those described in relation to the charge generating layer and the charge transporting layer.

The amount of the charge generating material contained in the single-layer-type photosensitive layer relative to the total solid content may be 0.1 mass % or more and 10 mass % or less, and is preferably 0.8 mass % or more and 5 mass % or less. The amount of the charge transporting material contained in the single-layer-type photosensitive layer relative to the total solid content may be 5 mass % or more and 50 mass % or less.

The method for forming the single-layer-type photosensitive layer is the same as the method for forming the charge generating layer and the charge transporting layer.

The thickness of the single-layer-type photosensitive layer may be, for example, 5 μm or more and 50 μm or less, and is preferably 10 μm or more and 40 μm or less.

Image Forming Apparatus (and Process Cartridge)

An image forming apparatus of an exemplary embodiment includes an electrophotographic photoreceptor, a charging unit that charges a surface of the electrophotographic photoreceptor, an electrostatic latent image forming unit that forms an electrostatic latent image on the charged surface of the electrophotographic photoreceptor, a developing unit that develops the electrostatic latent image on the surface of the electrophotographic photoreceptor by using a developer that contains a toner so as to form a toner image, and a transfer unit that transfers the toner image onto a surface of a recording medium. The photoreceptor of the present exemplary embodiment described above is used as the electrophotographic photoreceptor.

The image forming apparatus of the exemplary embodiment is applied to a known image forming apparatus, examples of which include an apparatus equipped with a fixing unit that fixes the toner image transferred onto the surface of the recording medium; a direct transfer type apparatus with which the toner image formed on the surface of the electrophotographic photoreceptor is directly transferred to the recording medium; an intermediate transfer type apparatus with which the toner image formed on the surface of the electrophotographic photoreceptor is first transferred to a surface of an intermediate transfer body and then the toner image on the surface of the intermediate transfer body is transferred to the surface of the recording medium; an apparatus equipped with a cleaning unit that cleans the surface of the electrophotographic photoreceptor after the toner image transfer and before charging; an apparatus equipped with a charge erasing unit that erases the charges on the surface of the electrophotographic photoreceptor by applying the charge erasing light after the toner image transfer and before charging; and an apparatus equipped with an electrophotographic photoreceptor heating member that elevates the temperature of the electrophotographic photoreceptor to reduce the relative temperature.

In the intermediate transfer type apparatus, the transfer unit includes, for example, an intermediate transfer body having a surface onto which a toner image is to be transferred, a first transfer unit that conducts first transfer of the toner image on the surface of the electrophotographic photoreceptor onto the surface of the intermediate transfer body, and a second transfer unit that conducts second transfer of the toner image on the surface of the intermediate transfer body onto a surface of a recording medium.

The image forming apparatus of this exemplary embodiment may be of a dry development type or a wet development type (development type that uses a liquid developer).

In the image forming apparatus of the exemplary embodiment, for example, a section that includes the electrophotographic photoreceptor may be configured as a cartridge structure (process cartridge) detachably attachable to the image forming apparatus. A process cartridge equipped with the photoreceptor of the present exemplary embodiment may be used as this process cartridge. The process cartridge may include, in addition to the electrophotographic photoreceptor, at least one selected from the group consisting of a charging unit, an electrostatic latent image forming unit, a developing unit, and a transfer unit.

Although some examples of the image forming apparatus of an exemplary embodiment are described below, these examples are not limiting. Only relevant sections illustrated in the drawings are described, and descriptions of other sections are omitted.

Figure 2:
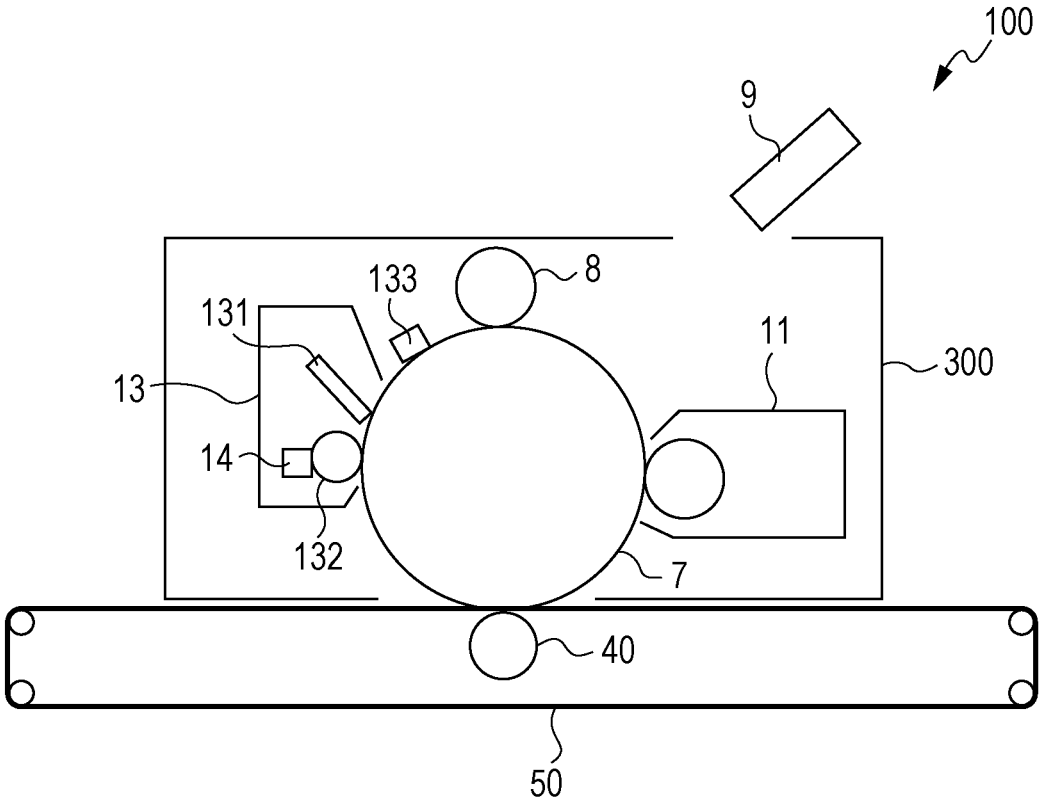
FIG. 2 is a schematic diagram illustrating one example of an image forming apparatus according to an exemplary embodiment.

FIG. 2 is a schematic diagram illustrating one example of an image forming apparatus according to an exemplary embodiment.

As illustrated in FIG. 2, an image forming apparatus 100 of this exemplary embodiment includes a process cartridge 300 equipped with an electrophotographic photoreceptor 7, an exposing device 9 (one example of the electrostatic latent image forming unit), a transfer device 40 (first transfer device), and an intermediate transfer body 50. In this image forming apparatus 100, the exposing device 9 is positioned so that light can be applied to the electrophotographic photoreceptor 7 from the opening of the process cartridge 300, the transfer device 40 is positioned to oppose the electrophotographic photoreceptor 7 with the intermediate transfer body 50 therebetween, and the intermediate transfer body 50 has a portion in contact with the electrophotographic photoreceptor 7. Although not illustrated in the drawings, a second transfer device that transfers the toner image on the intermediate transfer body 50 onto a recording medium (for example, a paper sheet) is also provided. The intermediate transfer body 50, the transfer device 40 (first transfer device), and the second transfer device (not illustrated) correspond to examples of the transfer unit.

The process cartridge 300 illustrated in FIG. 2 integrates and supports the electrophotographic photoreceptor 7, a charging device 8 (one example of the charging unit), a developing device 11 (one example of the developing unit), and a cleaning device 13 (one example of the cleaning unit)

in the housing. The cleaning device 13 has a cleaning blade (one example of the cleaning member) 131, and the cleaning blade 131 is in contact with the surface of the electrophotographic photoreceptor 7. The cleaning member may take a form other than the cleaning blade 131, and may be a conductive or insulating fibrous member that can be used alone or in combination with the cleaning blade 131.

Although an example of the image forming apparatus equipped with a fibrous member 132 (roll) that supplies a lubricant 14 to the surface of the electrophotographic photoreceptor 7 and a fibrous member 133 (flat brush) that assists cleaning is illustrated in FIG. 2, these members are optional.

The features of the image forming apparatus of this exemplary embodiment will now be described.

Charging Device

Examples of the charging device 8 include contact-type chargers that use conductive or semi-conducting charging rollers, charging brushes, charging films, charging rubber blades, and charging tubes. Known chargers such as non-contact-type roller chargers, and scorotron chargers and corotron chargers that utilize corona discharge are also used.

Exposing Device

Examples of the exposing device 9 include optical devices that can apply light, such as semiconductor laser light, LED, or liquid crystal shutter light, into a particular image shape onto the surface of the electrophotographic photoreceptor 7. The wavelength of the light source is to be within the spectral sensitivity range of the electrophotographic photoreceptor. The mainstream wavelength of the semiconductor lasers is near infrared having an oscillation wavelength at about 780 nm. However, the wavelength is not limited to this, and a laser having an oscillation wavelength on the order of 600 nm or a blue laser having an oscillation wavelength of 400 nm or more and 450 nm or less may be used. In order to form a color image, a surface-emitting laser light source that can output multi beams is also effective.

Developing Device

Examples of the developing device 11 include common developing devices that perform development by using a developer in contact or non-contact manner. The developing device 11 is not particularly limited as long as the aforementioned functions are exhibited, and is selected according to the purpose. An example thereof is a known developer that has a function of attaching a one-component developer or a two-component developer to the electrophotographic photoreceptor 7 by using a brush, a roller, or the like. In particular, a development roller that retains the developer on its surface may be used.

The developer used in the developing device 11 may be a one-component developer that contains only a toner or a two-component developer that contains a toner and a carrier. The developer may be magnetic or non-magnetic. Any known developers may be used as these developers.

Cleaning Device

A cleaning blade type device equipped with a cleaning blade 131 is used as the cleaning device 13.

From the viewpoint of making even the progress of wear at the surface layer of the photoreceptor, the cleaning blade 131 preferably has a contact portion that contacts the electrophotographic photoreceptor and that is constituted by a member in which the ratio (EIT/Re) of the indentation modulus (EIT [MPa]) to the rebound resilience (Re [%]) is 0.65 or more and the rebound resilience (Re [%]) is 25% or more.

The cleaning blade may be configured such that the member (hereinafter this member is referred to as a "contact member") that satisfies the aforementioned properties is provided at least in the contact portion between the cleaning blade 131 and the electrophotographic photoreceptor. In other words, the cleaning blade 131 may have a two-layer structure that includes a first layer that is formed of a contact member and contacts the surface of the electrophotographic photoreceptor and a second layer on the rear surface of the first layer, or may have three or more layers. Only a corner portion of a portion that contacts the electrophotographic photoreceptor may be constituted by the contact member, and the surrounding thereof may be constituted by a different material.

Figure 3:
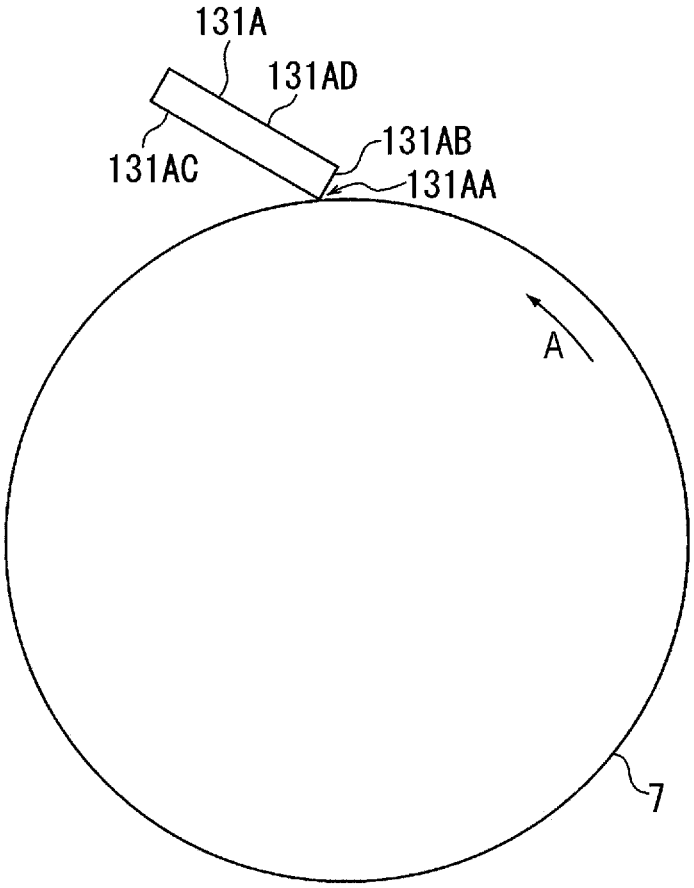
FIG. 3 is a schematic diagram illustrating one example of a cleaning blade according to an exemplary embodiment.
Figure 4:
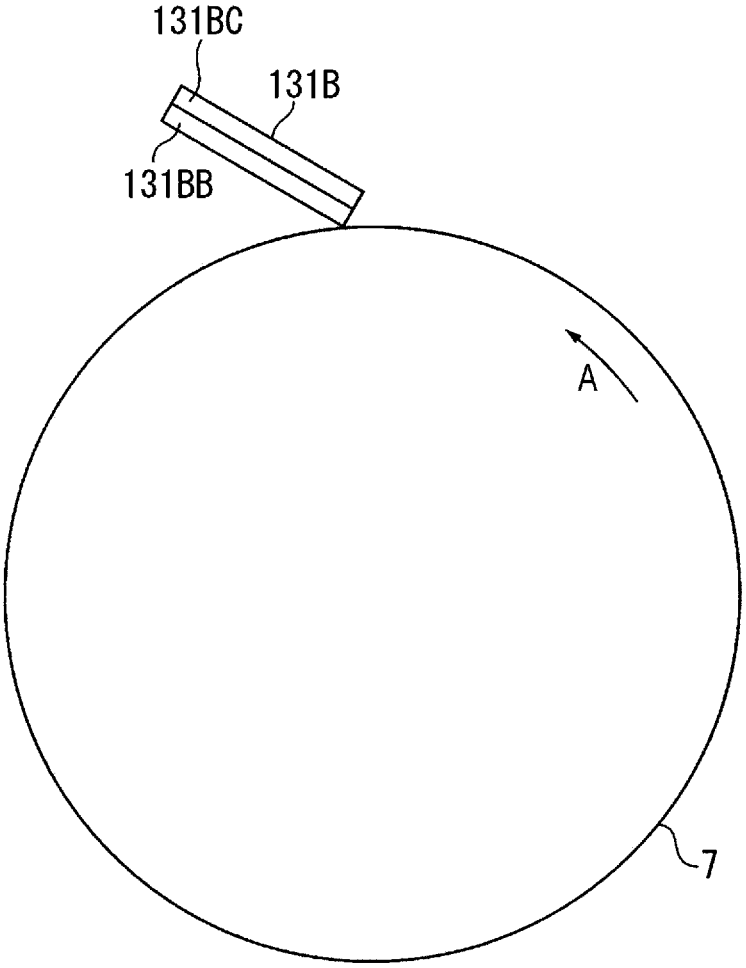
FIG. 4 is a schematic diagram illustrating another example of the cleaning blade according to an exemplary embodiment.
Figure 5:
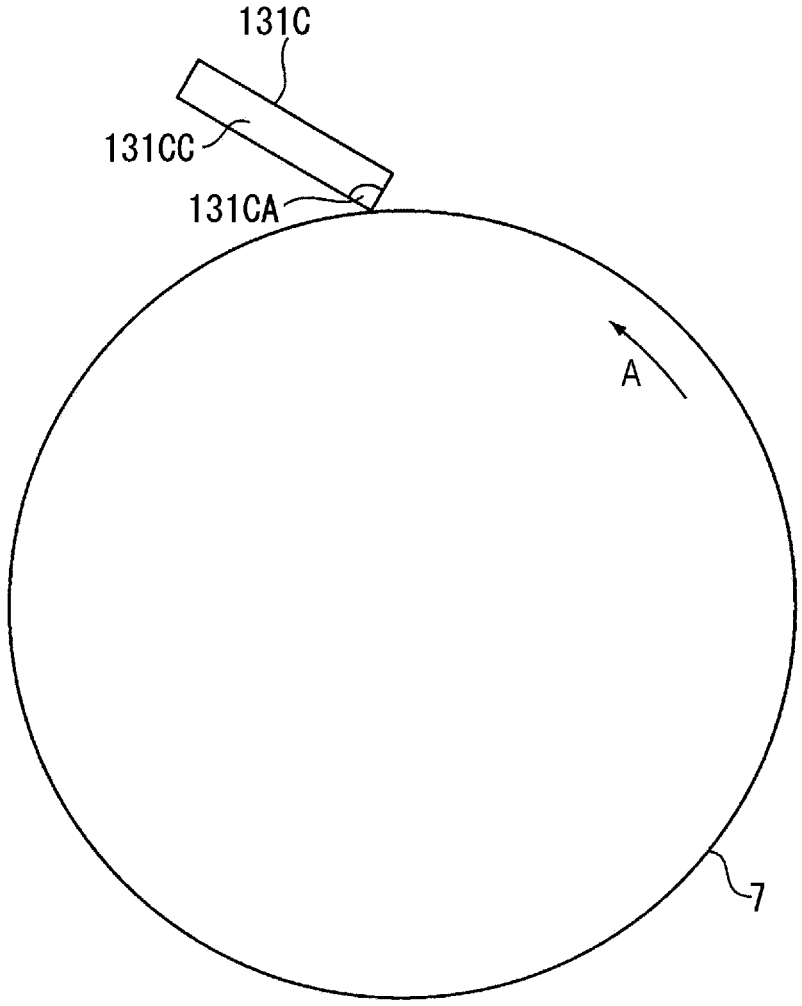
FIG. 5 is a schematic diagram illustrating yet another example of the cleaning blade according to an exemplary embodiment.

FIG. 3 is a schematic view illustrating a first example of the cleaning blade 131 and illustrates a state in which a cleaning blade 131A is in contact with the surface of an electrophotographic photoreceptor 7. FIG. 4 is a schematic view illustrating a second example of the cleaning blade 131 and illustrates a state in which a cleaning blade 131B is in contact with the surface of an electrophotographic photoreceptor 7. FIG. 5 is a schematic view illustrating a third example of the cleaning blade 131 and illustrates a state in which a cleaning blade 131C is in contact with the surface of an electrophotographic photoreceptor 7.

First, individual parts of the cleaning blade are described with reference to FIG. 3. As illustrated in FIG. 3, the cleaning blade 131A includes a contact portion (contact corner) 131AA that contacts the driven electrophotographic photoreceptor and cleans the surface of the electrophotographic photoreceptor 7, a tip surface 131AB having one side constituted by the contact corner 131AA and facing the upstream side in the driving direction (arrow A direction), a flank surface 131AC having one side constituted by the contact corner 131AA and facing the downstream side in the driving direction (arrow A direction), and a rear surface 131AD sharing one side with the tip surface 131AB and opposing the flank surface 131AC.

A direction parallel to the contact corner 131AA is referred to as a "depth direction", a direction that extends from the contact corner 131AA to the side where the tip surface 131AB is formed is referred to as a "thickness direction", and a direction that extends from the contact corner 131AA to the side where the flank surface 131AC is formed is referred to as a "width direction".

The cleaning blade 131A illustrated in FIG. 3 is entirely composed of a single material, including the portion (contact corner) 131AA that contacts the electrophotographic photoreceptor 7, in other words, the cleaning blade 131A is constituted solely by the contact member.

As illustrated in FIG. 4, the cleaning blade 131 may have a two-layer structure that includes a first layer 131BB and a second layer 131BC. The first layer 131BB includes a portion (contact corner) 131AA that contacts the electrophotographic photoreceptor 7, forms the entire surface on the flank surface 131AC side, and is constituted by a contact member. The second layer 131BC is formed on the rear surface 131AD side relative to the first layer and serves as a rear surface layer composed of a material different from the contact member.

As illustrated in FIG. 5, the cleaning blade 131 may have a structure that includes a contact member (edge member) 131CA and a rear member 131CC. The contact member 131CA is solely constituted by a contact member that includes a portion that contacts the electrophotographic photoreceptor 7, in other words, a contact corner 131AA, and has a shape of a quarter cylinder extending in the depth direction. A right-angle portion of the quarter cylinder forms the contact corner 131AA. The rear member 131CC is composed of a material different from the contact member and covers the side opposite of the rear surface 131AD side of the contact member 131CA in the thickness direction and the tip surface 131AB in the width direction. In other words, the rear surface member 131CC constitutes the portion other than the contact member 131CA.

Although FIG. 5 illustrates an example in which the contact member has a shape of a quarter cylinder, the shape is not limited to this. For example, the shape may be a quarter elliptic cylinder shape, a quadrangular prism shape with a square or rectangular cross-section, or the like.

Typically, the cleaning blade is bonded to a rigid plate support member and used.

Composition of Contact Member

The contact member in the cleaning blade 131 may contain a polyurethane rubber. The contact member may be constituted by a member in which the ratio (EIT/Re) of the indentation modulus (EIT [MPa]) to the rebound resilience (Re [%]) is 0.65 or more and the rebound resilience (Re [%]) is 25% or more.

Polyurethane Rubber

The polyurethane rubber is prepared by polymerizing at least a polyol component and a polyisocyanate component. If needed, the polyurethane rubber may be a polyurethane rubber prepared by polymerization by using a resin having a functional group that can react with isocyanate groups in the polyisocyanate in addition to the polyol component.

The polyurethane rubber may contain a hard segment and a soft segment. The "hard segment" and the "soft segment" refer to segments in the polyurethane rubber material. The material constituting the hard segment is relatively harder than the material constituting the soft segment, and the material constituting the soft segment is relatively softer than the material constituting the hard segment.

Examples of the material constituting the hard segment (hard segment material) include low-molecular-weight polyol components among polyol components, and a resin that has a functional group that can react with isocyanate groups in the polyisocyanate. Examples of the material constituting the soft segment (soft segment material) include high-molecular-weight polyol components among polyol components.

The average particle diameter of the aggregates of the hard segment is preferably 1 μm or more and 10 μm or less and more preferably 1 μm or more and 5 μm or less.

The frictional resistance of the surface of the contact member can be easily decreased by adjusting the average particle diameter of the aggregates of the hard segment to 1 μm or more. As a result, the blade behavior is stabilized, and local wear is readily suppressed.

Meanwhile, by adjusting the average particle diameter of the aggregates of the hard segment to 10 μm or less, chipping is easily suppressed.

The average particle diameter of the aggregates of the hard segment is measured as follows. An image is captured at a magnification of 20 by using a polarized microscope (BX51-P produced by Olympus Corporation), and binarized by performing image processing. The particle diameters (equivalent circle diameters) of the aggregates of twenty cleaning blades are measured at five points for each cleaning blade (particle diameters of five aggregates are measured at each point), and the average particle diameter is calculated from a total of 500 aggregates.

The image is binarized by using image processing software OLYMPUS Stream essentials (produced by Olympus Corporation), and the thresholds for hue, saturation, and lightness are adjusted so that the crystalline portions and hard segment aggregates appear in black and amorphous portions (corresponding to the soft segment) appear in white.

Polyol Component

The polyol component may contain a high-molecular-weight polyol and a low-molecular-weight polyol.

The high-molecular-weight polyol may have a number average molecular weight of 500 or more (preferably 500 or more and 5000 or less). Examples of the high-molecular-weight polyol include known polyols such as polyester polyols obtained by dehydration condensation between a low-molecular-weight polyol and a dibasic acid, polycarbonate polyols obtained by reaction between a low-molecular-weight polyol and an alkyl carbonate, polycaprolactone polyols, and polyether polyols. Examples of the commercially available products of the high-molecular-weight polyol include PLACCEL 205 and PLACCEL 240 produced by DAICEL CORPORATION.

The number average molecular weight is a value measured by gel permeation chromatography (GPC). The same applies hereinafter.

These high-molecular-weight polyols may be used alone or in combination.

The polymerization ratio of the high-molecular-weight polyol relative to all polymerization components of the polyurethane rubber may be 30 mol % or more and 50 mol % or less and is preferably 40 mol % or more and 50 mol % or less.

The low-molecular-weight polyol may have a molecular weight (number average molecular weight) of less than 500. The low-molecular-weight polyol is a material that functions as a chain extender and a crosslinking agent.

The low-molecular-weight polyol may be 1,4-butanediol. The ratio of 1,4-butanediol relative to all polyol components (high-molecular-weight polyol+low-molecular-weight polyol) is preferably more than 50 mol % but not more than 75 mol % (preferably 52 mol % or more and 75 mol % or less, more preferably 55 mol % or more and 75 mol % or less, and yet more preferably 55 mol % or more and 60 mol % or less).

The ratio of 1,4-butanediol relative to all low-molecular-weight polyols is preferably 80 mol % or more, more preferably 90 mol % or more, and yet more preferably 100 mol %. In other words, it is most preferable to use only 1,4-butanediol as the low-molecular-weight polyol component.

Examples of the low-molecular-weight polyols other than 1,4-butanediol include known diols (difunctional), triols (trifunctional), and tetrols (tetrafunctional) that serve as chain extenders and crosslinking agents.

These polyols other than 1,4-butanediol may be used alone or in combination.

The polymerization ratio of the low-molecular-weight polyol component relative to all polymerization components of the polyurethane rubber is preferably more than 50 mol % but not more than 75 mol %, preferably 52 mol % or more and 75 mol % or less, more preferably 55 mol % or more and 75 mol % or less, and yet more preferably 55 mol % or more and 60 mol % or less.

Polyisocyanate Component

Examples of the polyisocyanate component include 4,4'-diphenylmethane diisocyanate (MDI), 2,6-toluene diisocyanate (TDI), 1,6-hexane diisocyanate (HDI), 1,5-naphthalene diisocyanate (NDI), and 3,3-dimethylbiphenyl-4,4-diisocyanate (TODI).

The polyisocyanate component is more preferably 4,4'-diphenylmethane diisocyanate (MDI), 1,5-naphthalene diisocyanate (NDI), or hexamethylene diisocyanate (HDI).

These polyisocyanate components may be used alone or in combination.

The polymerization ratio of the polyisocyanate component relative to all polymerization components of the polyurethane rubber may be 5 mol % or more and 25 mol % or less and is preferably 10 mol % or more and 20 mol % or less.

Resin Having a Functional Group that can React with Isocyanate Groups

The resin having a functional group that can react with Isocyanate groups (hereinafter this resin is referred to as the "functional group-containing resin") may be flexible, and an aliphatic resin having a linear structure can be used from the viewpoint of flexibility. Specific examples of the functional group-containing resin include an acrylic resin containing two or more hydroxy groups, a polybutadiene resin containing two or more hydroxy groups, and an epoxy resin containing two or more epoxy groups.

Examples of the commercially available products of the acrylic resin containing two or more hydroxy groups include ACTFLOW produced by Soken Chemical & Engineering Co., Ltd. (grade: UMB-2005B, UMB-2005P, UMB-2005, UME-2005, etc.).

Examples of the commercially available products of the polybutadiene resin containing two or more hydroxy groups include R-45HT produced by Idemitsu Kosan Co., Ltd., etc.

The epoxy resin having two or more epoxy groups may be an epoxy resin having flexibility and high toughness compared to typical known epoxy resins that are typically hard and brittle. From the molecular structure aspect, the epoxy resin can have a main chain structure that has a structure that can enhance the mobility of the main chain (flexible skeleton), and examples of the flexible skeleton include alkylene skeletons, cycloalkane skeletons, and polyoxyalkylene skeletons, among which the polyoxyalkylene skeletons are particularly preferable.

From the physical property aspect, an epoxy resin having a low viscosity relative to the molecular weight compared to typical epoxy resins can be used. Specifically, the weight-average molecular weight is within the range of 900±100, and the viscosity at 25° C. is preferably within the range of 15000±5000 mPa·s and more preferably within the range of 15000±3000 mPa·s. Examples of the commercially available products of the epoxy resin having such properties include EPLICON EXA-4850-150 produced by DIC Corporation, etc.

Method for Producing Polyurethane Rubber

The polyurethane rubber is produced by a typical polyurethane production method such as a prepolymer method or a one-shot method. The prepolymer method is suitable since a polyurethane having excellent wear resistance and chipping resistance is obtained, but the production method is not limited to this.

The cleaning blade is prepared by molding a cleaning blade-forming composition prepared by the aforementioned method into a sheet by, for example, centrifugal molding, extrusion molding, or the like, and cutting the resulting sheet.

Examples of the catalyst used to produce the polyurethane rubber include amine compounds such as tertiary amines, quaternary ammonium salts, and organic metal compounds such as organic tin compounds.

Examples of the tertiary amines include trialkylamines such as triethylamine, tetralkyldiamines such as N,N,N',N'-tetramethyl-1,3-butanediamine, amino alcohols such as dimethyl ethanol amine, ethoxylated amines, ethoxylated diamines, ester amines such as bis(diethylethanolamine) adipate, triethylenediamine (TEDA), cyclohexylamine derivatives such as N,N-dimethylcyclohexylamine, morpholine derivatives such as N-methylmorpholine and N-(2-hydroxypropyl)-dimethylmorpholine, and piperazine derivatives such as N,N'-diethyl-2-methylpiperazine and N,N'-bis-(2-hydroxypropyl)-2-methylpiperazine.

Examples of the quaternary ammonium salts include 2-hydroxypropyltrimethylammonium octylate, 1,5-diazabicyclo[4.3.0]nonene-5 (DBN) octylate, 1,8-diazabicyclo[5.4.0]undecene-7 (DBU)-octylate, DBU-oleate, DBU-p-toluenesulfonate, DBU-formate, and 2-hydroxypropyltrimethylammonium formate.

Examples of the organic tin compounds include dialkyltin compounds such as dibutyltin dilaurate and dibutyltin di(2-ethylhexoate), stannous 2-ethylcaproate, and stannous oleate.

Among these catalysts, triethylenediamine (TEDA), which is a tertiary ammonium salt, is used from the viewpoint of hydrolysis resistance, and a quaternary ammonium salt is used from the viewpoint of processability. Among quaternary ammonium salts, 1,5-diazabicyclo[4.3.0]nonene-5 (DBN)-octylate, 1,8-diazabicyclo[5.4.0]undecene-7 (DBU)-octylate, and DBU-formate that have high reactivity are preferable for the use.

The catalyst content is preferably within the range of 0.0005 mass % or more and 0.03 mass % or less and is particularly preferably 0.001 mass % or more and 0.01 mass % or less of the entire polyurethane rubber constituting the contact member.

These catalysts are used alone or in combination.

Physical Properties of Contact Member

From the viewpoint of making even the progress of wear at the surface layer of the photoreceptor, the cleaning blade 131 may have a contact portion that contacts the electrophotographic photoreceptor and that is constituted by a member in which the ratio (EIT/Re) of the indentation modulus (EIT [MPa]) to the rebound resilience (Re [%]) is 0.65 or more and the rebound resilience (Re [%]) is 25% or more.

From the viewpoint of making even the progress of wear at the surface layer of the photoreceptor, the EIT/Re ratio (ratio of indentation modulus (EIT [MPa]) to the rebound resilience (Re [%])) of the contact member (polyurethane rubber member) is preferably 0.65 or more, more preferably 0.75 or more, and yet more preferably 0.85 or more. The upper limit of the EIT/Re ratio of the contact member is preferably 1.1 or less and more preferably 1.0 or less from the viewpoint of chipping resistance.

The rebound resilience (Re [%]) of the contact member (polyurethane rubber member) is preferably 25% or more, more preferably 28% or more, and yet more preferably 30% or more. The upper limit of the rebound resilience (Re [%]) of the contact portion is preferably 60% or less and more preferably 40% or less from the viewpoints of wear resistance and suppression of blade squeaking.

The indentation modulus (EIT [MPa]) of the contact member (polyurethane rubber member) is preferably 10 MPa or more and 30 MPa or less and more preferably 15 MPa or more and 25 MPa or less.

The indentation modulus (EIT) is measured in compliance with ISO 14577 (2002) from the slope within a load range of 65% to 95% of the maximum load in a unloading curve obtained at the time of unloading from the indenter load-penetration amount curve. The measurement conditions are as follows.

Measurement instrument: nanoindentation method dynamic supermicro hardness meter "PICODENTOR HM500" (tradename, produced by Fischer Instruments K.K.)

Indenter: conical Berkovich diamond indenter with a 120° face angle

Indentation depth of indenter: 20 μm

Indentation rate of indenter: 12.5 μm/sec

Unloading rate of indenter: 12.5 m/sec

The rebound resilience is determined in compliance with JIS K 6255 (1996) in a 23° C. environment by using a Lupke rebound resilience tester.

Composition of Non-Contact Member

Next, the composition of the non-contact member when the cleaning blade 131 includes a contact member and a region (non-contact member) other than the contact member that are composed of different materials as in the examples illustrated in FIGS. 4 and 5 is described.

The non-contact member can be composed of any known material as long as the function of supporting the contact member is obtained. Specific examples of the material used in the non-contact member include polyurethane rubber, silicone rubber, fluororubber, chloroprene rubber, and butadiene rubber. Among these, polyurethane rubber is recommendable. Examples of the polyurethane rubber include ester polyurethane and ether polyurethane, and ester polyurethane is particularly preferable.

Production of Cleaning Blade

In the case of the cleaning blade solely constituted by the contact member as illustrated in FIG. 3, the cleaning blade is produced by the aforementioned method for forming the contact member.

In the case of the cleaning blade having a multiple layer structure, such as a two layer structure, as illustrated in FIG. 4, the cleaning blade is prepared by bonding together a first layer that serves as the contact member and a second layer (when a layer structure including three or more layers is concerned, multiple second layers) that serves as the non-contact member. The bonding method may employ a double-sided tape, various adhesives, etc. Alternatively, the materials for the respective layers may be poured into a mold with time intervals during molding so that multiple layers are bonded together by the bonds between the materials without providing adhesive layers.

In the case of a structure having a contact member (edge member) and a non-contact member (rear surface member) as illustrated in FIG. 5, a first die having a cavity (region into which the composition for forming the contact member is poured) that corresponds to a semicircular column constituted by two contact members 131CA illustrated in FIG. 5 combined with the flank surfaces 131AC facing each other, and a second die having a cavity that corresponds to a shape constituted by two contact members 131CA and two non-contact members 131CC combined with the flank surfaces 131AC facing each other are prepared. A composition for forming the contact member is poured into the cavity of the first die and cured so as to form a first molded product having a shape of two contact member 131CA combined. Next, after the first die is removed, the second die is installed so that the first molded product is inside the cavity of the second die. Next, a composition for forming the non-contact member is poured into the cavity of the second die so as to cover the first molded product, and cured so as to form a second molded product having a shape constituted by two contact member 131CA and two non-contact member 131CC combined with the two flank surfaces 131AC facing each other. Next, the second molded product obtained thereby is cut at the middle, in other words, at the portion where the flank surfaces 131AC are formed, so that the semicircular column-shaped contact member is cut at the middle into quarter cylinders. The obtained product is further cut into predetermined dimensions so as to obtain a cleaning blade illustrated in FIG. 5.

In addition to the cleaning blade system, a fur brush cleaning system or a development-cleaning simultaneous system may be employed.

Transfer Device

Examples of the transfer device 40 include contact-type transfer chargers that use belts, rollers, films, rubber blades, etc., and known transfer chargers such as scorotron transfer chargers and corotron transfer chargers that utilize corona discharge.

Intermediate Transfer Body

A belt-shaped member (intermediate transfer belt) that contains semi-conducting polyimide, polyamide imide, polycarbonate, polyarylate, a polyester, a rubber, or the like is used as the intermediate transfer body 50. The form of the intermediate transfer body other than the belt may be a drum.

Figure 6:
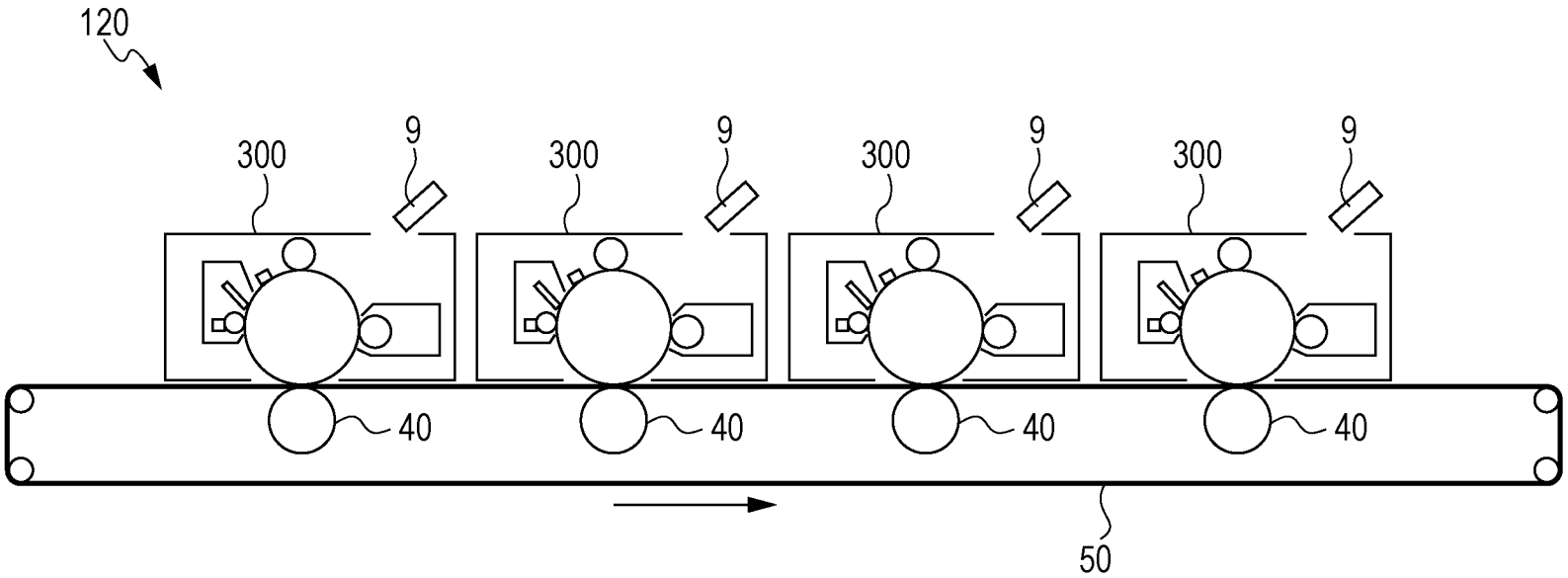
FIG. 6 is a schematic diagram illustrating another example of an image forming apparatus according to an exemplary embodiment.

FIG. 6 is a schematic diagram illustrating another example of an image forming apparatus according to an exemplary embodiment.

An image forming apparatus 120 illustrated in FIG. 6 is a tandem-system multicolor image forming apparatus equipped with four process cartridges 300. In the image forming apparatus 120, four process cartridges 300 are arranged in parallel on the intermediate transfer body 50, and one electrophotographic photoreceptor is used for one color. The image forming apparatus 120 is identical to the image forming apparatus 100 except for the tandem system.

EXAMPLES

Examples described below are not to be construed as limiting the present disclosure. In the description below, "parts" and "%" are all on a mass basis unless otherwise noted.

Production of Fluorine-Containing Resin Particles

Production of Fluorine-Containing Resin Particles (1)

Fluorine-containing resin particles (1) are produced as follows.

Into an autoclave, 3 L of deionized water, 3.0 g of ammonium perfluorooctanoate, and 110 g of paraffin wax (produced by Nippon Oil Corporation) serving as an emulsion stabilizer are charged, the interior is substituted with nitrogen three times and with tetrafluoroethylene (TFE) twice to remove oxygen, and stirring is performed at 250 rpm by adjusting the internal pressure to 1.0 MPa with TFE while maintaining the internal temperature to 70° C. Next, ethane in an amount equivalent to 150 cc at normal pressure serving as a chain transfer agent and 20 mL of an aqueous solution dissolving 300 mg of ammonium persulfate serving as a polymerization initiator are charged into the system, and the reaction is started. During the reaction, the temperature inside the system is maintained at 70° C., and TFE is continuously supplied so that the internal pressure of the autoclave is constantly maintained at 1.0±0.05 MPa. At the time 1000 g of TFE is consumed by the reaction after addition of the initiator, supply of TFE and stirring are stopped, and the reaction is terminated. Subsequently, particles are centrifugally separated, 400 parts by mass of methanol is taken, the mixture is washed for 10 minutes in a stirrer at 250 rpm while applying ultrasonic waves, and the supernatant is filtered. This operation is repeated three times, and the residue is dried at a reduced pressure at 60° C. for 17 hours.

Through the above-described steps, fluorine-containing resin particles (1) are produced.

Production of Fluorine-Containing Resin Particles (2)

Fluorine-containing resin particles (2) are produced as follows.

Into a barrier nylon bag, 100 parts by mass of a homopolytetrafluoroethylene fine powder (standard specific gravity measured in accordance with ASTM D 4895 (2004): 2.175) and 2.4 parts by mass of ethanol serving as an additive are placed, and the entire bag is purged with nitrogen so that the oxygen concentration is 10%. Subsequently, a cobalt −60γ line is applied at 150 kGy at room temperature to obtain a low-molecular-weight polytetrafluoroethylene powder. The obtained powder is crushed to obtain fluorine-containing resin particles (2).

Production of Fluorine-Containing Resin Particles (C1)

Fluorine-containing resin particles (C1) are produced as follows.

Into a barrier nylon bag, 100 parts by mass of a homopolytetrafluoroethylene fine powder (standard specific gravity measured in accordance with ASTM D 4895 (2004): 2.175) and 2.4 parts by mass of ethanol serving as an additive are placed. Subsequently, a cobalt −60γ line is applied at 150 kGy in air at room temperature to obtain a low-molecular-weight polytetrafluoroethylene powder. The obtained powder is crushed to obtain fluorine-containing resin particles (C1).

Production of Fluorine-Containing Resin Particles (C2)

Fluorine-containing resin particles (C2) are produced as follows.

Into a barrier nylon bag, 100 parts by mass of a homopolytetrafluoroethylene fine powder (standard specific gravity measured in accordance with ASTM D 4895 (2004): 2.175) and 2.4 parts by mass of ethanol serving as an additive are sampled, and the entire bag is substituted with nitrogen so that the oxygen concentration is 15%. Subsequently, a cobalt −60γ line is applied at 150 kGy at room temperature to obtain a low-molecular-weight polytetrafluoroethylene powder. The obtained powder is crushed to obtain fluorine-containing resin particles (C2).

Production of Fluorine-Containing Graft Polymer

The fluorine-containing graft polymer is produced as follows.

Into 500 mL a reactor equipped with a stirrer, a reflux cooling duct, a thermometer, and a nitrogen gas inlet port, 5 parts by mass of methyl isobutyl ketone is placed and stirred, and the solution temperature in the reactor is maintained at 80° C. in a nitrogen gas atmosphere. To the reactor, a mixed solution containing 9 parts by mass of perfluorohexylethyl acrylate, 21 parts by mass of macromonomer AA-6 (produced by Toagosei Co, Ltd.), 0.2 parts by mass of PERHEXYL O (produced by NIF Corporation) serving as a polymerization initiator, and 45 parts by mass of methyl isobutyl ketone is added dropwise by using a syringe dropping pump over a period of 2 hours. After completion of dropwise addition, stirring is further continued for two more hours, the solution temperature is elevated to 90° C., and stirring is performed for two more hours.

To the methyl isobutyl ketone resin solution obtained after the reaction, 400 mL of methanol is added dropwise to precipitate a fluorine-containing graft polymer. The precipitated solid is separated by filtration and dried to obtain a fluorine-containing graft polymer.

Production of Cleaning Blade

<Cleaning Blades (1) to (7) and Cleaning Blades (C1) to (C4)>

Cleaning blades are produced according to Table 1 by varying the types and molar ratios of the high-molecular-weight polyol, the low-molecular-weight polyol, and the isocyanate component according to the polyol blend, and curing and aging conditions. Specific details are as follows.

First, adipic acid (HOOC—$C_4H_8$—COOH) and 1,4-butanediol are mixed at 1:1 (molar ratio), polymerized, and processed so that —OH is at the terminals so as to obtain a polyester polyol obtained by polymerizing a linear diol having four carbon atoms (butanediol). The obtained polyester polyol has a number average molecular weight of 2000.

Next, a polyester polyol serving as a high-molecular-weight polyol, 1,4-butanediol serving as a low-molecular-weight polyol (1,4-BD, chain extender), 4,4'-diphenylmethane diisocyanate (MDI, Millionate MT produced by NIPPON POLYURETHANE KOGYO KK) serving as an isocyanate, and trimethylol propane (TMP produced by MITSUBISHI GAS CHEMICAL COMPANY, INC.) serving as a crosslinking agent are blended at amounts (molar ratios) indicated in Table 1 and reacted in a nitrogen atmosphere at 80° C. for 2 hours to prepare a cleaning blade-forming composition A1.

Next, the cleaning blade-forming composition A1 is poured into a centrifugal molding machine with a die adjusted at 140° C., and cured and aged under the curing and aging conditions indicated in Table 1. The cooled cured product is cut to obtain a cleaning blade having a width of 8 mm and a thickness of 2 mm.

However, for the cleaning blade (6), polytetramethylene ether glycol (PTMG) is used as the high-molecular-weight polyol.

The curing and aging conditions A to E indicated in Table 1 are as follows.

- Curing and aging condition A: After performing the curing reaction at 100° C. for 1 hour, aging and heating is performed at 110° C. for 24 hours.
- Curing and aging condition B: After performing the curing reaction at 110° C. for 1 hour, aging and heating is performed at 110° C. for 24 hours.
- Curing and aging condition C: After performing the curing reaction at 110° C. for 2 hours, aging and heating is performed at 110° C. for 48 hours.
- Curing and aging condition D: After performing the curing reaction at 100° C. for 40 minutes, aging and heating is performed at 110° C. for 24 hours.
- Curing and aging condition E: After performing the curing reaction at 100° C. for 40 minutes, aging and heating is performed at 100° C. for 24 hours.

In addition, the "mold" indicated in Table 1 is the value in terms of mol % of each component relative to the total of polyol components (high-molecular-weight polyol+low-molecular-weight polyol).

Example 1

Preparation of Photoreceptor

A photoreceptor is prepared as follows by using the obtained fluorine-containing resin particles.

One hundred parts of zinc oxide (average particle diameter: 70 nm, produced by Tayca Corporation, specific surface area: 15 $m^2/g$) is mixed with 500 parts of tetrahydrofuran, and 1.4 parts of a silane coupling agent (KBE503 produced by Shin-Etsu Chemical Co., Ltd.) is added thereto, followed by stirring for 2 hours. Then, tetrahydrofuran is distilled away by vacuum distillation, baking is performed at 120° C. for 3 hours, and, as a result, zinc oxide surface-treated with the silane coupling agent is obtained.

One hundred and ten parts of the surface-treated zinc oxide and 500 parts of tetrahydrofuran are mixed and stirred, a solution prepared by dissolving 0.6 parts of alizarin in 50 parts of tetrahydrofuran is added to the resulting mixture, and the resulting mixture is stirred at 50° C. for 5 hours. Subsequently, alizarin-doped zinc oxide is separated by vacuum filtration and vacuum-dried at 60° C. As a result, alizarin-doped zinc oxide is obtained.

Sixty parts of the alizarin-doped zinc oxide, 13.5 parts of a curing agent (blocked isocyanate, Sumidur 3175 produced by Sumitomo Bayer Urethane Co., Ltd.), 15 parts of a butyral resin (S-LEC BM-1 produced by Sekisui Chemical Co., Ltd.), and 85 parts of methyl ethyl ketone are mixed to obtain a mixed solution. Thirty eight parts of this mixed solution and 25 parts of methyl ethyl ketone are mixed, and the resulting mixture is dispersed for 2 hours in a sand mill using 1 mmϕ glass beads to obtain a dispersion.

To the obtained dispersion, 0.005 parts of dioctyltin dilaurate serving as a catalyst and 30 parts of silicone resin particles (Tospearl 145 produced by Momentive Performance Materials Japan LLC) are added to obtain an undercoat layer-forming solution. The coating solution is applied to a cylindrical aluminum substrate, and dried and cured at 170° C. for 30 minutes so as to form an undercoat layer having a thickness of 24 μm.

Next, 1 part of hydroxygallium phthalocyanine having intense diffraction peaks at Bragg's angles (2θ±0.2°) of 7.5°, 9.9°, 12.5°, 16.3°, 18.6°, 25.1°, and 28.3° in an X-ray diffraction spectrum, 1 part of polyvinyl butyral (S-LEC BM-5 produced by Sekisui Chemical Co., Ltd.), and 80 parts of n-butyl acetate are mixed, and the resulting mixture is dispersed with glass beads in a paint shaker for 1 hour to prepare a charge generating layer-forming solution. The obtained solution is applied to the undercoat layer on the conductive support by dip-coating, and heated at 130° C. for 10 minutes to form a charge generating layer having a thickness of 0.15 μm.

In 150 parts of toluene and 350 parts of tetrahydrofuran, 45 parts of a benzidine compound represented by formula (CTM1) below serving as a charge transporting material and 55 parts of a polymer compound (viscosity-average molecular weight: 40,000) having a repeating unit represented by formula (PCZ1) below serving as a binder resin are dissolved, and, thereto, 8 parts of the fluorine-containing resin particles (1), 0.4 parts of fluorine-containing graft polymer, and 0.06 parts (50 ppm of the silicone component relative to the outermost surface layer) of KP-340 (trade name, produced by Shin-Etsu Chemical Co., Ltd) serving as a defoaming agent (D1) are added. The resulting mixture is processed with a high-pressure homogenizer five times so as to obtain a charge transporting layer-forming coating solution.

The obtained coating solution is applied to the charge generating layer by dip-coating, and heated at 130° C. for 45 minutes to prepare a charge transporting layer having a thickness of 31 μm.

(CTM1)

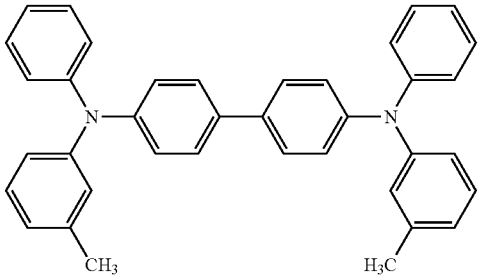

(PCZ1)

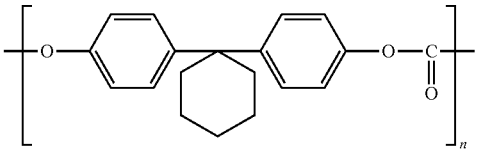

Photoreceptors are prepared through the steps described above.

Preparation of Process Cartridge

The prepared photoreceptor is loaded onto a process cartridge equipped with the cleaning blade (1) for an image forming apparatus (DocuCentre-V C7775 produced by Fuji Xerox Co., Ltd.) to obtain a process cartridge.

Examples 2 to 30 and Comparative Examples 1 to 10

Photoreceptors and process cartridges are prepared as in Example 1 except that the type and added amount of the fluorine-containing resin particles, the added amount of the fluorine-containing graft polymer, the type and added amount of the defoaming agent, and the type of the cleaning blade are changed as indicated in Tables 2 to 4.

Evaluation

Evaluation of Occurrence of Air Bubbles

For each example, whether air bubbles occur during application of the charge transporting layer-forming coating solution or not is observed with naked eye and evaluated on the basis of the following standard.

Standard for Evaluation of Air Bubbles

A: No air bubbles occur.

B: Air bubbles occur slightly.

C: Many air bubbles occur.

Evaluation of Dispersibility of Fluorine-Containing Resin Particles

From each of the photoreceptors obtained in the examples, a multilayer section including layers from the undercoat layer to the outermost surface layer is cut out by using a single-edged trimming razor (produced by Nisshin EM Co., Ltd.) and is embedded in a photocurable acrylic resin (product name: D-800 produced by JEOL Ltd. DATUM Business Operations). Next, the embedded section is cut by a microtome method (microtome device produced by LEICA) with a diamond knife so as to expose a cross section of the multilayer section. The cross section of the section is observed with a laser microscope OLS-1100 produced by Olympus Optical Co., Ltd., under the condition of a step feed of 0.01 μm, and evaluated on the basis of the following standard.

Standard for Evaluation

A: No aggregation is observed.

B: Weak aggregation is observed in some parts.

C: Extensive aggregation is observed.

Actual Device Evaluation

Image Forming Apparatus for Evaluation

The obtained electrophotographic photoreceptor is attached to DocuCentre-VC7775 produced by Fuji Xerox Co., Ltd.

By using a surface potentiometer (Trek 334 produced by Trek Japan Co., Ltd.), a surface potential probe is installed at a position 1 mm remote from the surface of the photoreceptor and in the region to be measured.

This apparatus is used as the image forming apparatus for evaluating the charge-retaining property and the residual potential.

Evaluation of Charge-Retaining Property

The chargeability of the obtained photoreceptor is evaluated as follows.

After the surface potential after charging is set to −700 V, by using the image forming apparatus for evaluation, an all-screen halftone image having an image density of 30% is output on 70,000 sheets of A4 paper in a high-temperature, high-humidity environment (temperature: 28° C., humidity: 85% RH). Then the surface potential is measured with a surface potentiometer and evaluated by the following evaluation standard:

A: Surface potential is −700 V or more but less than −680 V

B: Surface potential is −680 V or more but less than −660 V

C: Surface potential is −660 V or more and less than −680 V.

Evaluation of Residual Potential

The residual potential of the obtained photoreceptors is evaluated as follows.

After the surface potential after charging is set to −700 V, by using the image forming apparatus for evaluation, an all-screen halftone image having an image density of 30% is output on 70,000 sheet of A4 paper in a high-temperature, high-humidity environment (temperature: 28° C., humidity: 85% RH).

The initial residual potential of the photoreceptor after outputting 100 sheets and after charge erasing, and the aged residual potential of the photoreceptor after outputting 70,000 sheets and after charge erasing are measured with a surface potentiometer, the difference (absolute value) is determined, and the following evaluation is made.

A: The difference in residual potential is less than 10 V.

B: The difference in residual potential is 10 V or more and less than 20 V.

C: The difference in residual potential is 20 V or more.

Descriptions in Tables 2 to 4 are as follows.

The defoaming agent type "D2" indicates a fluorine defoaming agent (product name: Surflon S-651 produced by AGC SEIMI CHEMICAL CO., LTD.).

"-" indicates that the corresponding component is not contained.

TABLE 1

| Cleaning blade | | Type | (1) | (2) | (3) | (4) | (5) | (6) | (7) | (C1) | (C2) | (C3) | (C4) |
|---|---|---|---|---|---|---|---|---|---|---|---|---|---|
| Material composition | High-molecular-weight polyol | Type | Polyester polyol (adipate) | Polyester polyol (adipate) | Polyester polyol (adipate) | Polyester polyol (adipate) | Polyester polyol (adipate) | Polytetramethylene ether glycol (PTMG) | Polyester polyol (adipate) | Polyester polyol (adipate) | Polyester polyol (adipate) | Polyester polyol (adipate) | Polyester polyol (adipate) |
| | | mol % | 45 | 35 | 30 | 35 | 48 | 45 | 35 | 50 | 45 | 45 | 23 |
| | Low-molecular-weight polyol | Type | 1.4-BG | 1.4-BG | 1.4-BG | 1.4-BG | 1.4-BG | 1.4-BG | 1.4-BG | 1.4-BG | 1.4-BG | 1.4-BG | 1.4-BG |
| | | mol % | 55 | 65 | 70 | 65 | 52 | 55 | 65 | 50 | 55 | 55 | 77 |
| | Isocyanate | Type | MDI | MDI | MDI | MDI | MDI | MDI | MDI | MDI | MDI | MDI | MDI |
| | | mol % | 18 | 18 | 18 | 18 | 18 | 18 | 18 | 18 | 18 | 18 | 18 |
| | Cross-linking agent | Type | TMP | TMP | TMP | TMP | TMP | TMP | TMP | TMP | TMP | TMP | TMP |
| | | mol % | 0.8 | 0.7 | 0.5 | 1.2 | 0.8 | 1.5 | 1.5 | 0.8 | 1.3 | 2 | 0.3 |
| Production condition | Curing and aging conditions | | A | A | A | B | A | E | E | A | C | D | E |

TABLE 2

| | Fluorine-containing resin particles | | | Fluorine-containing graft polymer | Defoaming agent | | | Physical properties of outermost surface layer | | | | | Evaluation | | | |
|---|---|---|---|---|---|---|---|---|---|---|---|---|---|---|---|---|
| | Type | Amount of COOH (number) | Added amount (parts) | Added amount relative to particles (mass %) | Type | Added amount relative to outermost surface layer (ppm) | Added amount relative to particles (mass %) | Dielectric constant | Contact angle (°) | Cleaning blade Type | EIT/Re | Re (%) | Occurrence of air bubbles | Dispersibility | Charge-retaining property | Residual potential |
| Example 1 | (1) | 7 | 8 | 4.5 | D1 | 100 | 0.140 | 3.75 | 92 | (1) | 0.82 | 28 | A | A | A | B |
| Example 2 | (1) | 7 | 8 | 9.0 | D1 | 10 | 0.014 | 3.80 | 90 | (1) | 0.82 | 28 | B | A | A | A |

TABLE 2-continued

| | Fluorine-containing resin particles | | | Fluorine-containing graft polymer | Defoaming agent | | | Physical properties of outermost surface layer | | Cleaning blade | | | Evaluation | | | |
|---|---|---|---|---|---|---|---|---|---|---|---|---|---|---|---|---|
| | Type | Amount of COOH (number) | Added amount (parts) | Added amount relative to particles (mass %) | Type | Added amount relative to outermost surface layer (ppm) | Added amount relative to particles (mass %) | Dielectric constant | Contact angle (°) | Type | EIT/Re | Re (%) | Occurrence of air bubbles | Dispersibility | Charge-retaining property | Residual potential |
| Example 3 | (1) | 7 | 8 | 4.5 | D2 | 10 | 0.014 | 3.80 | 90 | (1) | 0.82 | 28 | B | A | A | A |
| Example 4 | (1) | 7 | 8 | 4.5 | D2 | 100 | 0.140 | 3.80 | 92 | (1) | 0.82 | 28 | A | A | A | A |
| Example 5 | (2) | 30 | 8 | 4.5 | D1 | 100 | 0.140 | 3.75 | 92 | (1) | 0.82 | 28 | B | A | B | B |
| Example 6 | (1) | 7 | 8 | 4.5 | D1 | 100 | 0.140 | 3.75 | 92 | (1) | 0.82 | 28 | A | A | A | B |
| Example 7 | (1) | 7 | 8 | 9.0 | D1 | 100 | 0.140 | 3.90 | 92 | (1) | 0.82 | 28 | B | A | A | A |
| Example 8 | (1) | 7 | 8 | 6.0 | D1 | 100 | 0.140 | 3.80 | 92 | (1) | 0.82 | 28 | A | A | A | A |
| Example 9 | (1) | 7 | 8 | 4.5 | D1 | 10 | 0.014 | 3.75 | 90 | (1) | 0.82 | 28 | B | A | A | B |
| Example 10 | (1) | 7 | 8 | 4.5 | D1 | 150 | 0.210 | 3.75 | 97 | (1) | 0.82 | 28 | A | A | A | B |
| Example 11 | (1) | 7 | 8 | 4.5 | D1 | 60 | 0.084 | 3.75 | 93 | (1) | 0.82 | 28 | B | A | A | B |
| Example 12 | (1) | 7 | 8 | 9.0 | D1 | 50 | 0.070 | 3.90 | 92 | (1) | 0.82 | 28 | B | A | A | A |
| Example 13 | (1) | 7 | 8 | 9.0 | D1 | 10000 | 14.000 | 3.90 | 105 | (1) | 0.82 | 28 | A | A | B | A |
| Example 14 | (1) | 7 | 10 | 5.0 | D1 | 8900 | 10.000 | 3.78 | 104 | (1) | 0.82 | 28 | A | A | A | A |
| Example 15 | (1) | 7 | 10 | 5.0 | D1 | 45 | 0.050 | 3.78 | 92 | (1) | 0.82 | 28 | B | A | A | A |

TABLE 3

| | Fluorine-containing resin particles | | | Fluorine-containing graft polymer | Defoaming agent | | | Physical properties of outermost surface layer | | Cleaning blade | | | Evaluation | | | |
|---|---|---|---|---|---|---|---|---|---|---|---|---|---|---|---|---|
| | Type | Amount of COOH (number) | Added amount (parts) | Added amount relative to particles (mass %) | Type | Added amount relative to outermost surface layer (ppm) | Added amount relative to particles (mass %) | Dielectric constant | Contact angle (°) | Type | EIT/Re | Re (%) | Occurrence of air bubbles | Dispersibility | Charge-retaining property | Residual potential |
| Example 16 | (1) | 7 | 8 | 4.5 | D1 | 120 | 0.170 | 3.75 | 96 | (1) | 0.82 | 28 | A | A | A | A |
| Example 17 | (1) | 7 | 8 | 4.5 | D1 | 4500 | 6.300 | 3.75 | 104 | (1) | 0.82 | 28 | A | A | A | A |
| Example 18 | (1) | 7 | 8 | 4.5 | D1 | 80 | 0.110 | 3.75 | 94 | (1) | 0.82 | 28 | B | A | A | A |
| Example 19 | (1) | 7 | 8 | 4.5 | D1 | 6000 | 8.400 | 3.75 | 105 | (1) | 0.82 | 28 | B | A | B | A |
| Example 20 | (1) | 7 | 8 | 4.5 | D1 | 100 | 0.140 | 3.75 | 92 | (1) | 0.82 | 28 | A | A | A | B |
| Example 21 | (1) | 7 | 8 | 4.5 | D1 | 100 | 0.140 | 3.75 | 92 | (2) | 0.91 | 26 | A | A | A | B |
| Example 22 | (1) | 7 | 8 | 4.5 | D1 | 100 | 0.140 | 3.75 | 92 | (3) | 0.97 | 25 | A | A | A | B |
| Example 23 | (1) | 7 | 8 | 4.5 | D1 | 100 | 0.140 | 3.75 | 92 | (4) | 0.65 | 32 | A | A | A | B |
| Example 24 | (1) | 7 | 8 | 4.5 | D1 | 100 | 0.140 | 3.75 | 92 | (5) | 0.86 | 27 | A | A | A | B |
| Example 25 | (1) | 7 | 8 | 4.5 | D1 | 100 | 0.140 | 3.75 | 92 | (6) | 0.62 | 30 | A | A | A | B |

TABLE 3-continued

| | Fluorine-containing resin particles | | | Fluorine-containing graft polymer | Defoaming agent | | | Physical properties of outermost surface layer | | Cleaning blade | | | Evaluation | | | |
|---|---|---|---|---|---|---|---|---|---|---|---|---|---|---|---|---|
| | Type | Amount of COOH (number) | Added amount (parts) | Added amount relative to particles (mass %) | Type | Added amount relative to outermost surface layer (ppm) | Added amount relative to particles (mass %) | Dielectric constant | Contact angle (°) | Type | EIT/Re | Re (%) | Occurrence of air bubbles | Dispersibility | Charge-retaining property | Residual potential |
| Example 26 | (1) | 7 | 8 | 4.5 | D1 | 100 | 0.140 | 3.75 | 92 | (7) | 0.93 | 30 | A | A | A | B |
| Example 27 | (1) | 7 | 8 | 4.5 | D1 | 100 | 0.140 | 3.75 | 92 | (Cl) | 0.82 | 28 | A | A | A | B |
| Example 28 | (1) | 7 | 8 | 4.5 | D1 | 100 | 0.140 | 3.75 | 92 | (C2) | 0.57 | 32 | A | A | A | B |
| Example 29 | (1) | 7 | 8 | 4.5 | D1 | 100 | 0.140 | 3.75 | 92 | (C3) | 0.54 | 43 | A | A | A | B |
| Example 30 | (1) | 7 | 8 | 4.5 | D1 | 100 | 0.140 | 3.75 | 92 | (C4) | 1.39 | 18 | A | A | A | B |

TABLE 4

| | Fluorine-containing resin particles | | | Fluorine-containing graft polymer | Defoaming agent | | | Physical properties of outermost surface layer | | Cleaning blade | | | Evaluation | | | |
|---|---|---|---|---|---|---|---|---|---|---|---|---|---|---|---|---|
| | Type | Amount of COOH (number) | Added amount (parts) | Added amount relative to particles (mass %) | Type | Added amount relative to outermost surface layer (ppm) | Added amount relative to particles (mass %) | Dielectric constant | Contact angle (°) | Type | EIT/Re | Re (%) | Occurrence of air bubbles | Dispersibility | Charge-retaining property | Residual potential |
| Comparative Example 1 | (C1) | 75 | 8 | 5.0 | D1 | 50 | 0.070 | 3.78 | 92 | (1) | 0.82 | 28 | A | A | C | B |
| Comparative Example 2 | (1) | 7 | 8 | 4.5 | — | 0 | 0.000 | 3.60 | 88 | (1) | 0.82 | 28 | C | A | A | B |
| Comparative Example 3 | (1) | 7 | 8 | 3.0 | D1 | 50 | 0.070 | 3.70 | 92 | (1) | 0.82 | 28 | A | C | A | C |
| Comparative Example 4 | (1) | 7 | 8 | 3.0 | D2 | 50 | 0.070 | 3.70 | 92 | (1) | 0.82 | 28 | A | C | A | C |
| Comparative Example 5 | (C2) | 40 | 8 | 5.0 | D1 | 100 | 0.140 | 3.78 | 92 | (1) | 0.82 | 28 | C | A | C | C |
| Comparative Example 6 | (1) | 7 | 8 | 3.0 | D1 | 100 | 0.140 | 3.70 | 92 | (1) | 0.82 | 28 | C | C | A | C |
| Comparative Example 7 | (1) | 7 | 8 | 10.0 | D1 | 100 | 0.140 | 4.00 | 92 | (1) | 0.82 | 28 | C | A | A | C |
| Comparative Example 8 | (1) | 7 | 8 | 4.5 | D1 | 5 | 0.007 | 3.75 | 88 | (1) | 0.82 | 28 | C | A | A | C |
| Comparative Example 9 | (1) | 7 | 8 | 4.0 | D1 | 100 | 0.140 | 3.73 | 92 | (1) | 0.82 | 28 | A | C | A | C |

TABLE 4-continued

| | Fluorine-containing resin particles | | | Fluorine-containing graft polymer | Defoaming agent | | | Physical properties of outermost surface layer | | Cleaning blade | | | Evaluation | | | |
|---|---|---|---|---|---|---|---|---|---|---|---|---|---|---|---|---|
| | Type | Amount of COOH (number) | Added amount (parts) | Added amount relative to particles (mass %) | Type | Added amount relative to outermost surface layer (ppm) | Added amount relative to particles (mass %) | Dielectric constant | Contact angle (°) | Type | EIT/Re | Re (%) | Occurrence of air bubbles | Dispersibility | Charge-retaining property | Residual potential |
| Comparative Example 10 | (1) | 7 | 8 | 10.0 | D1 | 100 | 0.140 | 3.95 | 92 | (1) | 0.82 | 28 | C | A | A | C |

The aforementioned results demonstrate that the photoreceptors of the examples have lower residual potentials and occurrence of air bubbles in the surface of the outermost surface layer is suppressed.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An electrophotographic photoreceptor comprising:

a conductive substrate; and a photosensitive layer on the conductive substrate, wherein:

the electrophotographic photoreceptor has an outermost surface layer that contains fluorine-containing resin particles and a fluorine-containing graft polymer, fluorine-containing resin particles contain 0 or more and 30 or less carboxy groups per $10^6$ carbon atoms, outermost surface layer has a dielectric constant of 3.75 or more and 3.90 or less, and a contact angle of pure water on the outermost surface layer is 90° or more.

2. The electrophotographic photoreceptor according to claim 1, wherein the outermost surface layer has a dielectric constant of 3.80 or more and 3.90 or less, and the contact angle of pure water on the outermost surface layer is 95° or more.

3. An electrophotographic photoreceptor comprising:

a conductive substrate; and a photosensitive layer on the conductive substrate, wherein:

the electrophotographic photoreceptor has an outermost surface layer that contains fluorine-containing resin particles, a fluorine-containing graft polymer, and a defoaming agent, the fluorine-containing resin particles contain 0 or more and 30 or less carboxy groups per $10^6$ carbon atoms, an amount of the fluorine-containing graft polymer relative to an amount of the fluorine-containing resin particles is 4.5 mass % or more and 9.0 mass % or less, an amount of the defoaming agent relative to the outermost surface layer is 10 ppm or more and 10000 ppm or less, the outermost surface layer has a dielectric constant of 3.75 or more and 3.90 or less, and a contact angle of pure water on the outermost surface layer is 90° or more.

4. The electrophotographic photoreceptor according to claim 3, wherein the defoaming agent is at least one defoaming agent selected from a silicone defoaming agent and a fluorine defoaming agent.

5. The electrophotographic photoreceptor according to claim 4, wherein the defoaming agent is dimethylpolysiloxane.

6. The electrophotographic photoreceptor according to claim 3, wherein the amount of the defoaming agent relative to the amount of the fluorine-containing resin particles is 0.01 mass % or more and 15 mass % or less.

7. The electrophotographic photoreceptor according to claim 4, wherein the amount of the defoaming agent relative to the amount of the fluorine-containing resin particles is 0.01 mass % or more and 15 mass % or less.

8. The electrophotographic photoreceptor according to claim 5, wherein the amount of the defoaming agent relative to the amount of the fluorine-containing resin particles is 0.01 mass % or more and 15 mass % or less.

9. The electrophotographic photoreceptor according to claim 3, wherein the amount of the defoaming agent relative to the outermost surface layer is 100 ppm or more and 5000 ppm or less.

10. The electrophotographic photoreceptor according to claim 4, wherein the amount of the defoaming agent relative to the outermost surface layer is 100 ppm or more and 5000 ppm or less.

11. The electrophotographic photoreceptor according to claim 5, wherein the amount of the defoaming agent relative to the outermost surface layer is 100 ppm or more and 5000 ppm or less.

12. The electrophotographic photoreceptor according to claim 6, wherein the amount of the defoaming agent relative to the outermost surface layer is 100 ppm or more and 5000 ppm or less.

13. The electrophotographic photoreceptor according to claim 7, wherein the amount of the defoaming agent relative to the outermost surface layer is 100 ppm or more and 5000 ppm or less.

14. The electrophotographic photoreceptor according to claim 8, wherein the amount of the defoaming agent relative to the outermost surface layer is 100 ppm or more and 5000 ppm or less.

15. A process cartridge detachably attachable to an image forming apparatus, the process cartridge comprising the electrophotographic photoreceptor according to claim 1.

16. The process cartridge according to claim 15, further comprising:

a cleaning unit that has a cleaning blade that contacts a surface of the electrophotographic photoreceptor to clean the electrophotographic photoreceptor, wherein:

the cleaning blade has a contact portion that contacts the electrophotographic photoreceptor, and the contact portion is constituted by a member in which a ratio (EIT/Re) of an indentation modulus (EIT [MPa]) to a rebound resilience (Re [%]) is 0.65 or more, and the rebound resilience (Re [%]) is 25% or more.

17. An image forming apparatus comprising:

the electrophotographic photoreceptor according to claim 1;

a charging unit that charges a surface of the electrophotographic photoreceptor;

an electrostatic latent image forming unit that forms an electrostatic latent image on the charged surface of the electrophotographic photoreceptor;

a developing unit that develops the electrostatic latent image on the surface of the electrophotographic photoreceptor by using a developer that contains a toner so as to form a toner image; and a transfer unit that transfers the toner image onto a surface of a recording medium.

18. The image forming apparatus according to claim 17, further comprising:

a cleaning unit that has a cleaning blade that contacts a surface of the electrophotographic photoreceptor to clean the electrophotographic photoreceptor, wherein:

the cleaning blade has a contact portion that contacts the electrophotographic photoreceptor, and the contact portion is constituted by a member in which a ratio (EIT/Re) of an indentation modulus (EIT [MPa]) to a rebound resilience (Re [%]) is 0.65 or more, and the rebound resilience (Re [%]) is 25% or more.

* * * * *